US005626181A

United States Patent [19]

Lotz et al.

[11] Patent Number: 5,626,181

[45] Date of Patent: May 6, 1997

[54] CONTINUOUS STEEL CASTING PLANT WITH AN IN- OR OFF-LINE SYSTEM TO DEBURR OXY-GAS CUTTING BEARDS AND CUTTING BEADS AT STRANDS, SLABS, AND BLOOMS

[75] Inventors: Horst K. Lotz; Matthias Lotz, both of Hofheim-Wallau, Germany

[73] Assignee: Gega Corporation, Pittsburgh, Pa.

[21] Appl. No.: 402,993

[22] Filed: Mar. 10, 1995

[30] Foreign Application Priority Data

Mar. 11, 1994 [EP] European Pat. Off. ..... 94103765

[51] Int. Cl.[6] ..... B22D 11/12

[52] U.S. Cl. ..... 164/263; 409/298; 409/303; 409/345

[58] Field of Search ..... 164/262, 263, 164/460, 70.1; 409/138, 297, 301, 303, 298, 345, 348, 326; 451/260, 182, 184, 124, 130, 131; 83/914

[56] References Cited

U.S. PATENT DOCUMENTS

| | | | |
|---|---|---|---|
| 3,377,896 | 4/1968 | Corta | 409/138 |
| 3,515,029 | 6/1970 | Gambini | 409/138 |
| 4,357,817 | 11/1982 | Linsinger | 409/301 |
| 4,362,448 | 12/1982 | Hasebe et al. | 409/301 |
| 5,259,440 | 11/1993 | Lotz et al. | 409/297 |

FOREIGN PATENT DOCUMENTS

| | | |
|---|---|---|
| 3210951 | 9/1991 | Japan . |
| 1389946 | 12/1985 | U.S.S.R. . |

*Primary Examiner*—Joseph J. Hail, III
*Assistant Examiner*—Randolph S. Herrick
*Attorney, Agent, or Firm*—Walter J. Blenko, Jr.; Alan G. Towner; Eckert Seamans Cherin & Mellott

[57] ABSTRACT

Apparatus for removing burrs from flame cut steel slabs including multiple deburring pistons extendably mounted in a piston body. Pressurization of the piston body causes extension of the pistons, while rotation of the piston body positions the deburring pistons at an inclined angle with respect to the work piece.

12 Claims, 26 Drawing Sheets

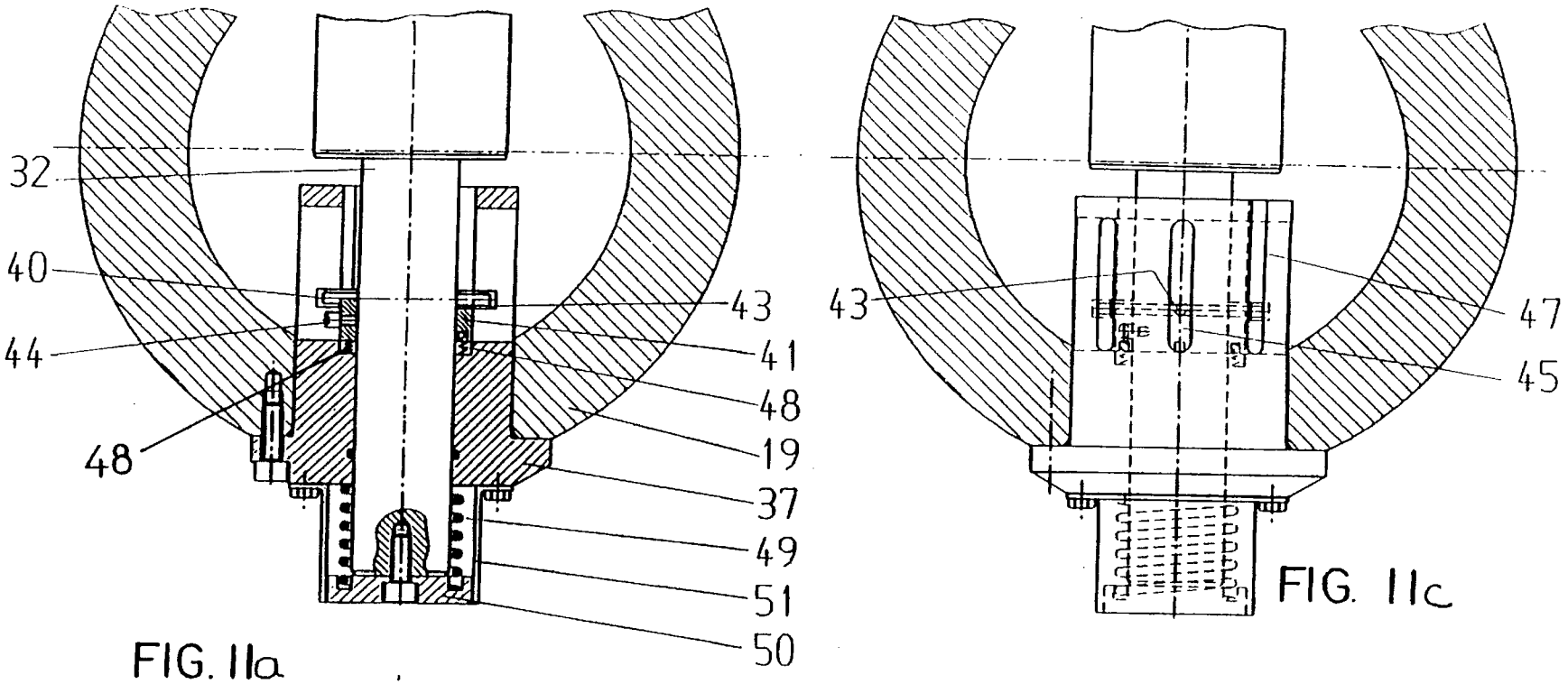
FIG. 11c
FIG. 11a
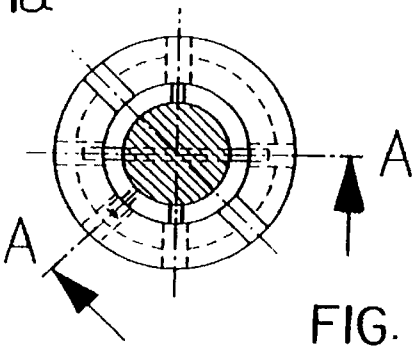
FIG. 11b (Deburring Force)

CONTINUOUS STEEL CASTING PLANT WITH AN IN- OR OFF-LINE SYSTEM TO DEBURR OXY-GAS CUTTING BEARDS AND CUTTING BEADS AT STRANDS, SLABS, AND BLOOMS

FIELD OF THE INVENTION

When flame-cutting with oxygen, especially in continuous steel casting plants, burrs consisting of a mix of brittle iron oxide and steel are formed at both lower flame-cutting edges, i.e., at the front and at the end of each work piece that has been cut-off due to the downward flow of hot slag. Some of the burrs hang down from the edges like icicles, other burrs of relatively flat rolls form across the lower edges of the work piece, and other burrs are formed with varying shapes and sizes. The type of burrs formed depends on the composition and the temperature of the material as well as on the chemo-physical operation rate of the cutting tools. In any case, the presence of such burrs is a nuisance during finishing work, if not during the transport of the work piece.

The avoidance of such cutting burrs would be desirable, but this is not realistic. Depending on the relevant circumstances, a substantial reduction of the size will be possible, but the size of the burr cannot be maintained within acceptable limits without additional cleaning.

DESCRIPTION OF PRIOR ART

In order to eliminate such burrs as soon as possible upon flame-cutting, there are a number of methods and procedures, i.e.:

- by melting off, flame-cutting off or flame-scarfing off using a hand-held oxygen torch,
- by melting off, flame-cutting off or flame-scarfing off using an oxygen torch machine,
- by manual knocking off or chiseling off,
- by knocking off, pushing off, or sheafing off using machines equipped with hammer-type, chisel-type, or shear blade-type tools.

While flame deburring methods show advantages in view of a high deburring speed, they have substantial disadvantages due to fume production, slag splashing, water requirements, as well as the danger of fire and explosion. For this reason, there is a growing demand for mechanical deburring methods, which, apart from the expenditure for mechanical equipment and energy, only entail time consumption and the disposal of the burrs. Part of the time spent is due to the proper alignment of the burr and the deburrer with each other and the fact that the burr can only be deburred from the work piece surface towards the edge. Another time loss is due to slowly advancing and repetitious step-after-step procedures, which are required for concavely or convexly shaped lower surfaces, i.e., for continuously cast slabs in order to eliminate the burr completely, not merely in the middle of convex cross sections or towards the outside of concave cross sections. Such distorted cross sections of the work piece result from internal and external cooling conditions of the slab.

The simplest mechanical deburrer known consists of a rocking shear (EPA 87301501.0) swiveling around a rotating axis and pressing a sheafing edge against the lower slab surface when the burr approaches. This rocking and rotational movement adjusts to any differences in height of the lower slab surface. However, the apparatus is not well suited to deburr crown-shaped deformations of the lower surface. With such equipment, a good deburring effect is limited to geometrically planar lower surfaces.

Another machine (patent application filed by the Company Interstate) comprising an upwardly pressed arm and simultaneously advanced shear disc moving forward and backward is more expensive. The burr is knocked off stepwise by the shear disc, depending on its size. The cantilevered arm of quite considerable length and the number and type of motions result in a slow but still successfully operating deburrer which requires a high expenditure for maintenance and substantial space at one side of the work piece.

A third successful deburring method is achieved by a roller-shaped deburrer (Patent Application filed by the Company Plakoma) with welded-on shear rings. This roller is pressed up while the slab is travelling above it, and the shear rings arranged one after another and along the roller body will lift the slab and shear off the burr piece by piece. This allows only one single shear ring operating at the roller until, upon lowering the work piece onto the roller, another lifting and shearing operation is effected by the next shear ring. This process is very noisy and requires a most accurate position of the work piece for deburring if good results are to be achieved. Furthermore, it is quite time consuming.

Hammers fixed to the perimeter of a quickly rotating roller will enable a particularly fast but also quite noisy deburring, the burr being knocked off by small pieces and a high number of strikes at the lower edge of a work piece traveling over this roller. High installation cost, high wear and the necessary protection against burr and hammer pieces flying off, as well as against the high levels of noise, are the main disadvantages of this type of apparatus.

All the devices described above have an additional disadvantage in so far as their use is restricted to simple cross sections, i.e., mainly to straight burr lines.

BRIEF DESCRIPTION OF THE DRAWINGS

The invention is illustrated in the accompanying drawings in which:

FIGS. 11*a*–11*c* are sectional views of a deburring piston mounted in a piston body in accordance with another embodiment of the present invention;

DESCRIPTION OF PREFERRED EMBODIMENTS

The prior art methods and machines mentioned above are made obsolete by mechanical deburring devices for removing burrs from flame cut slabs (EPA 90 11 20 27.9) which deburr more reliably and completely, work relatively fast, require less space and do not produce any noise. Such a conventional deburring machine, is shown in FIG. 1, and is indicated generally at (10).

Figure 1:
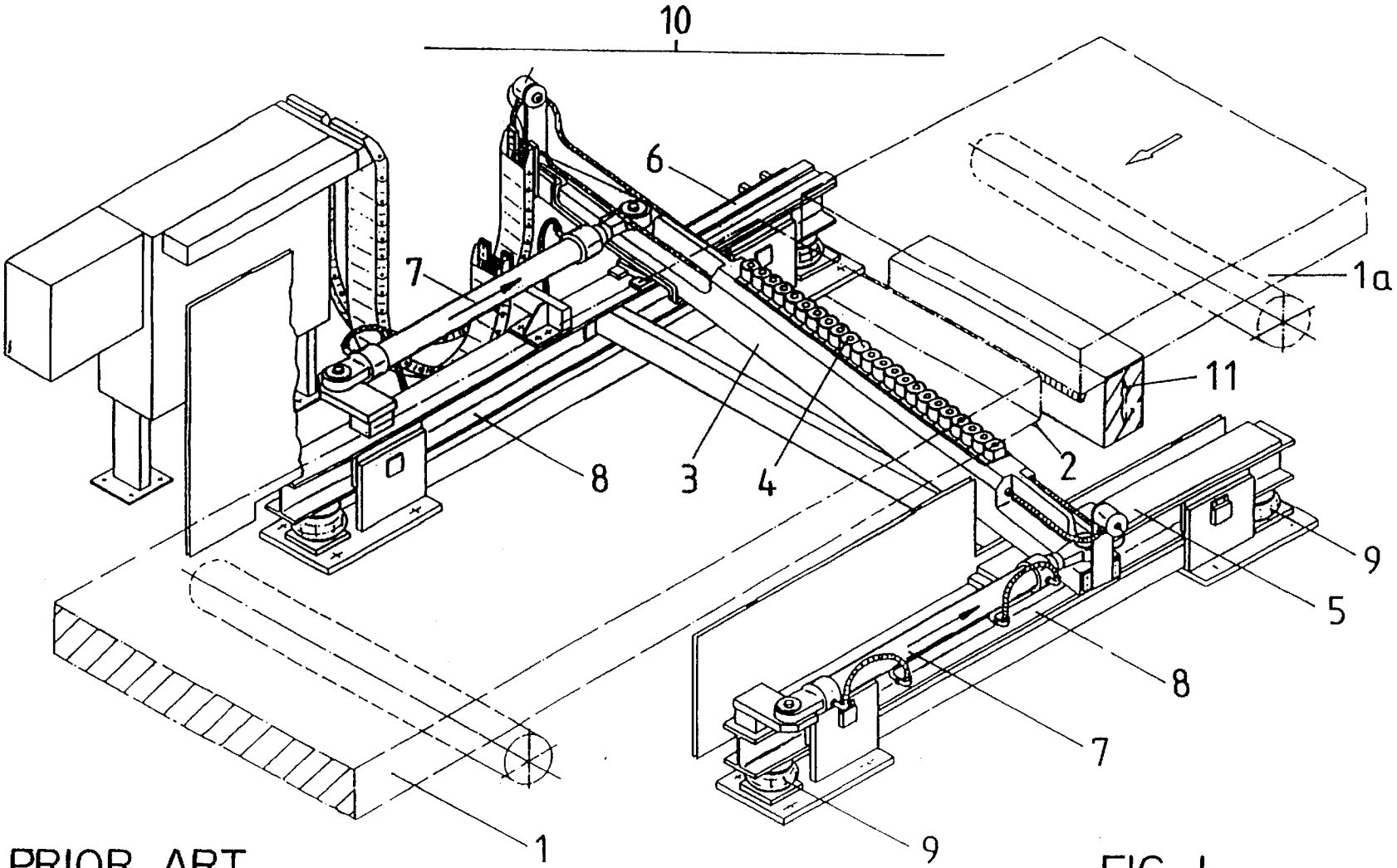
FIG. 1 PRIOR ART
FIG. 1 is a perspective view of a known type of prior art mechanical deburring apparatus.

FIG. 1 illustrates a deburring beam (3) arranged in an inclined way with a number of individually actuated deburring pistons (4) below and in front of a work piece (1) (e.g., a slab) with a cutting burr (2). Both sides of the shear beam (3) rest on deburring sides (5) which are moved forward and backward on slide guides for the deburring process by means of the hydraulic deburring cylinders (7). All the above mentioned parts rest on two main frames (8) at both sides of the work piece (1) which can be lifted by two lifting cylinders (9) each.

In case of a deburring by moving the work piece, it is possible to do so without the movement and drive parts, i.e, deburring slide (5), slide guides (6), and deburdng cylinders (7). A normal operating cycle using this deburring machine (10) is described as follows:

The work pieces (1 or 1*a* respectively) travel into the operating area of the deburring machine (10) forward or backward respectively to face the deburring beam (3), if necessary with the aid of a liftable and lowerable stop (11). The lifting cylinders (9) lift the deburring beam (3) above the main frames (8), deburring slides (5), and slide guides (6) into an operating position just below the work piece (1). By means of their pushing cylinders, the deburring pistons (4) are subsequently pressed up individually against the more or less plane lower surface of the work piece (1) near the cutting burr (2). Thereupon, the deburring cylinders (7) push the deburring beam (3), which is mounted slightly inclined towards the cutting burr (2). Hence, the deburdng pistons (4) of the deburring beam are pushed one after another against the cutting burr (2) and will shear it off. The deburring pistons (4) which rise behind the work piece (1) will be retracted by the double-acting pushing cylinders (12). Subsequently, the deburring beam (3) will again be shifted under the end of a second work piece (1*a*), the deburring pistons (4) will individually be pressed up again, and a deburring procedure will be performed in the opposite direction. Thereafter, the deburring pistons (4) and the deburring beam (3) will lower again, and the work pieces (1 and 1*a*) will travel off and into a new operating position respectively.

The deburring machine (10) provides a reliable and successful operation, but it is quite heavy and expensive as well as hard to maintain. The replacement of the deburring pistons (4) is difficult and time-consuming. In addition, the burrs at longitudinal cuts or at complex cross-sectional cuts can only be removed with difficulties.

Figure 2:
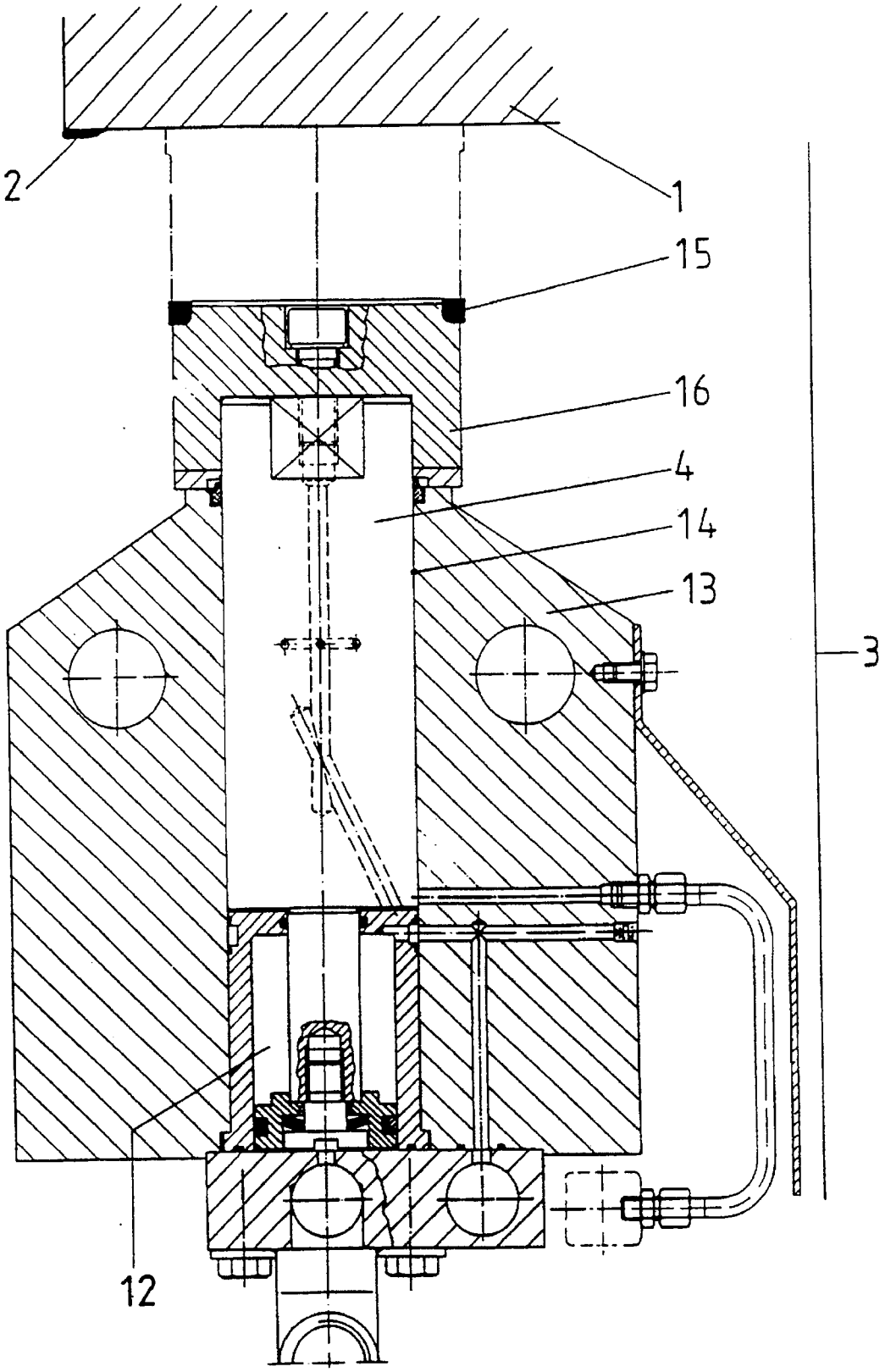
PRIOR ART FIG. 2
FIG. 2 is a sectional view of one of the individually actuated deburring pistons of the apparatus shown in FIG. 1.

FIG. 2 shows the cross-section of the conventional deburring beam (3) used in the deburring machine (10) described above which will be explained hereafter in order to enable a better understanding of the invention. The deburring beam body (13), which is fully machined out of a bigger raw material piece, is provided with as many guiding bores (14) as necessary and with the pushing cylinder (12). In those bores, deburring pistons (4) with their shear caps (16) screwed on can individually move up and down. For this purpose, the pressure of the compressed air in the pushing cylinder (12) has to be high enough so that the highly tough cutting edge (15) of the shear cap (16) having a surface of about 20 $cm^2$ presses strongly against the lower surface of a work piece (1) such that it does not slip over a flat and hard cutting burr during the deburring operation.

Due to the high pressure mentioned above the deburring process will generate friction between the surface of the cutting edge (15) and the lower surface of the work piece counteracting the deburring movement which will add to the initial shearing force, thus considerably increasing the surface pressure between the deburring piston (4) and the guiding bore (14)—even with noticeably bad lever conditions—and deforming or strongly wearing the guiding bore (14). In order to avoid this effect, the length of the deburring piston (4) has to be increased and replaceable guiding sleeves of a high strength (not shown in the figure) have to be employed.

The situation will be even more critical if the cutting edge (15) travels up onto the flat cutting burr (2) which, in view of its quite disadvantageous small inclination angle, will transform the shearing force into a strong vertical force counteracting the pushing force. For this purpose, the pushing force has to be initially provided as a very heavy force, enabling safe deburring with a wearing cutting edge (15). On the other hand, however, the shearing force and the surface pressures at the deburring piston (4) will increase to an undesirable extent. The danger of the cutting edge (15) travelling up onto the cutting burr (2) will increase if the ring face of the cutting edge (15) meets the receding or projecting shapes of the work piece (1) in front of the cutting burr (2) and creates a gap between the work piece and the cutting edge.

Figure 27:
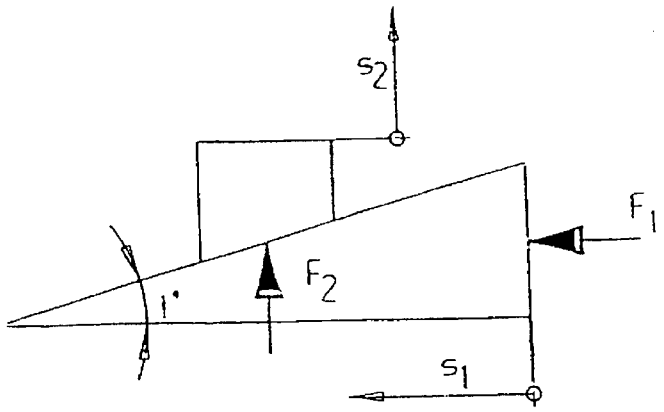
FIG. 27 is a diagram relating to the calculation of deburring force.
Figure 28:
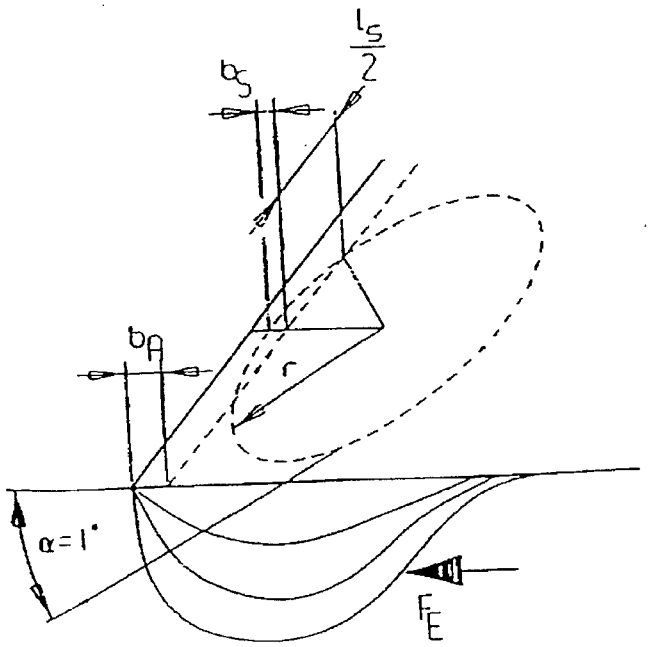
FIG. 28 is another diagram relating to the calculation of deburring force.

For such a case, the explanatory exemplary calculation of the required maximum deburring force would be as follows and as shown in FIGS. 27 and 28:

Calculation of the Deburring Force $F_E = F_S + F_R$

ASSUMPTIONS:

Shearing Force: $F_S = S \cdot \tau_a$

Shear Surface $S$ = $l_S \cdot b_S$ (Shear head width × shear surface width)

= 124 mm · 1.5 mm max./transverse strain $\tau_a$ = $0.8 \cdot Rm$ (tensile strength)

= $0.8 \cdot 1000$ n/mm³

(Tensile Strength $Rm$ = 500 · 1450 N/mm³ (C 25)(30 Cr Ni Mo 8))

Friction Force: $F_R = F \cdot \mu_M$

Weight and pushing up force $F = F_2$ results from $\mu_M = 0.2$ (Scales on steel)

$$F_1 \cdot S_1 = F_2 \cdot S_2$$

$$F_2 = F_1 \cdot \frac{S_1}{S_2}$$

$$\frac{S_1}{S_2} = tg\,\alpha \cdot \frac{S_1}{S_2} = \frac{1}{tg\,\alpha}$$

$$F_2 = \frac{F_1}{tg\,\alpha}$$

$$F_R = F_2 \cdot \mu_M = \frac{F_2}{tg\,\alpha} \cdot \mu_M$$

EXECUTION:

Shear head $\phi$ = 124 mm
Shear head $r$ = 62 mm $$\max. F_E = F_S + F_R$$

$$= F_1 + F_1 \cdot \frac{\mu_M}{tg\,\alpha} \quad da\ F_S = F_1$$

-continued

Calculation of the Deburring Force $F_E = F_S + F_R$ $$\max. F_E = F_S \cdot \left(1 + \frac{\mu_M}{tg\,\alpha}\right)$$

$$= l_S \cdot b_S \cdot \tau_S \cdot \left(1 + \frac{\mu_M}{tg\,\alpha}\right)$$

$$\max. F_E = 10.6 \cdot 1.5 \cdot 800 \cdot \left(1 + \frac{0.2}{0.0175}\right)$$

$$= 10.6 \cdot 1.5 \cdot 800 \cdot (1 + 11.4)$$

$$= 10.6 \cdot 1.5 \cdot 800 \cdot 12.4$$

$$= \underline{159.000\ \text{N}}$$

Breaking Elongation $A$ = 15% (between 6% and 25%)

max. $b_A = b_S \cdot A = 1.5 \cdot 0.15 = \underline{0.225\ \text{mm}}$ $$\frac{l_S}{2} = \sqrt{r^2 - (r - b_A)^2}$$

$$l_S = 2 \cdot \sqrt{62^2 - (61.775)^3}$$

$$= 2 \cdot \sqrt{3844 - 3816.15} = \sqrt{27.85} = 2 \cdot 5.2773 = \underline{10.5546\ \text{mm}}$$

The burr will detach under the circumstances mentioned above if the maximum deburring force $F_S$=159,000N has generated the transverse elongation of 15% of the lift of approximately 1.5 mm of the metallic bond between the burr and the work piece and presses against a burr width of approximately 10.5 mm, the relevant burr deformation being disregarded.

While the position of the work pieces to be deburred may not be critical in the deburring machine (10) depending on the deburring travel planned, for certain operations, lighter work pieces (1) will, however, require clamping devices during the deburring process of cutting burrs which are usually in the lower area. In addition, the high pushing forces for deburring are very disadvantageous because of wear and dimensioning, which will particularly apply in case of a fast deburring.

It is desirable to improve the operational reliability of several individually supplied and controlled deburring cylinders as well as to achieve simpler maintenance by easy replacement of the deburring pistons from one side only and a better use of the total circumference of the cutting edge of the deburring piston (4). Hence, further development of the deburring machine (10) is necessary with regard to application possibilities, expenditure for the deburring machine (10) itself, and its auxiliary equipment, as well as improved maintenance and simplified operation.

Figure 3:
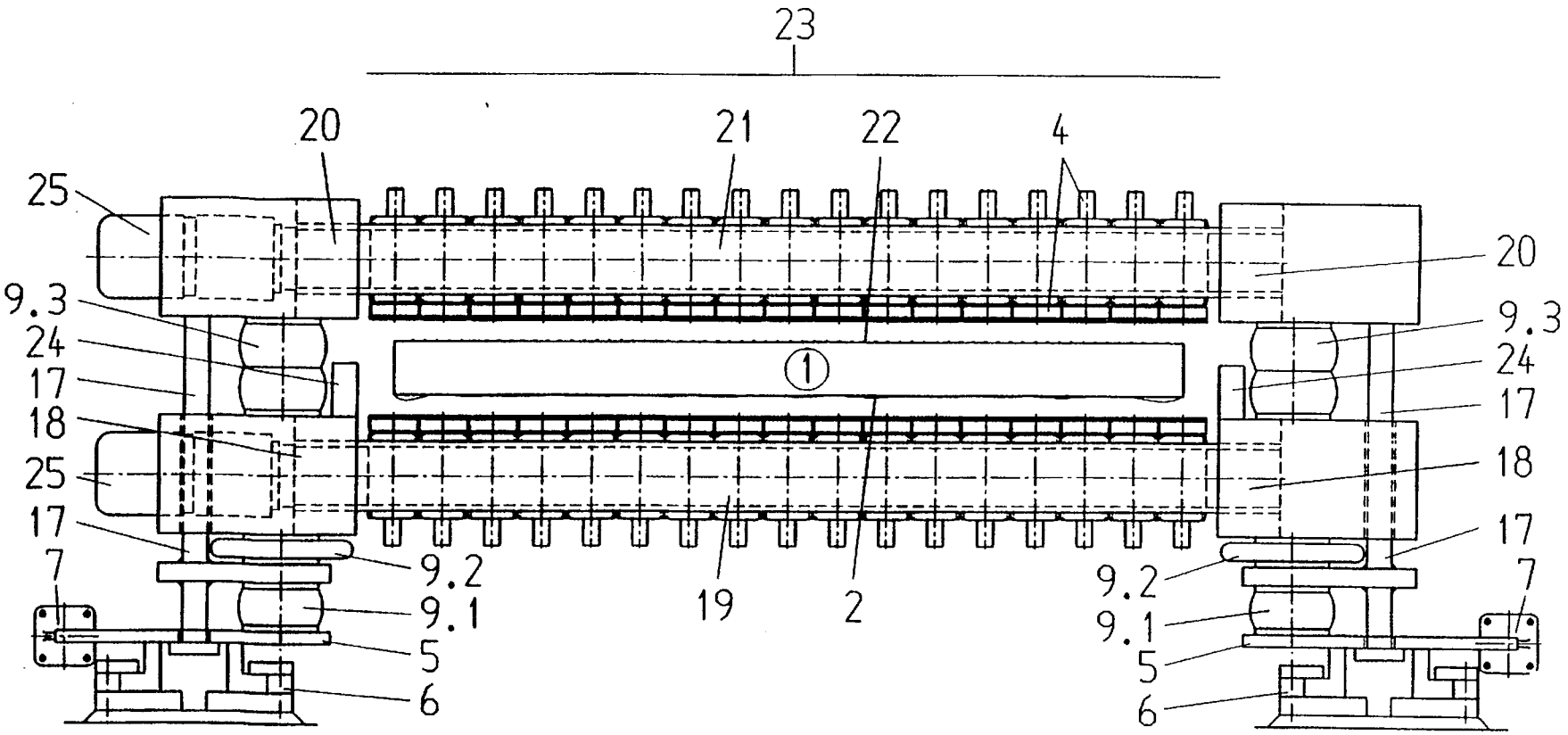
FIG. 3 is a side elevational view of a deburring apparatus showing a piston body and associated deburring pistons above and below a work piece.

As shown in FIG. 3, the apparatus of the present invention may include a unilateral or double-sided slide guide (6) with a deburring slide (5) movable in the axis of the work piece (1) by deburring cylinders (7). These components support a lifting frame (17) with limited height adjustment via air-operated lifting cylinders (9.1). The swivel bearings (18) for the lower piston body (19) are arranged in these lifting frames and supported by further lifting cylinders (9.2), whereas the swivel beatings (20) for the upper piston body (21) are fixed at the upper section of the lifting frame (17). Further lifting cylinders (9.3) are installed between the shiftable swivel beatings (18) of the lower piston body (19) and the upper piston body (21) which cause the piston bodies (19 and 21) to travel apart and the lifting frame (17) to move up into the stating position due to a joint action with the lifting cylinders (9.1) located between the deburring slide (5) and the lower lifting frame (17). If a work piece (1), marked by a cutting burr (2) at its lower end with cutting burrs (22) at its upper end, is moved into the deburrer (23) (designated as element 23 herein to distinguish over the conventional deburrer (10) shown in FIG. 1), the lifting cylinders (9.2) arranged in the lifting frame (17) below the swivel bearings (18) of the lower piston body (19) will push the deburrer up against the lower surface of the work piece (1) to be deburred and simultaneously push the lifting frame (17) with the upper piston body (21) downward against the upper surface of the work piece (1) to be deburred by the movement of the deburring slides (5) with the hydraulic deburring cylinders (7). If, for transport reasons, the work piece (1) is fed into the deburrer upside down, i.e., with the cutting burr (2) on top and the cutting burrs (22) down, effective deburring will equally be achieved. In any case, the deburrer (23) will not need a downholder if the pushing force from below is higher than the proportional weight of the slab. However, the second piston body (21) can be equipped with sliding caps, guide shoes, rolls, or the piston body itself can be designed as a down holding roll (21) for lighter work pieces (1).

Spacer blocks (24) are inserted between the lower swivel bearing and the upper arrival swivel bearing (18, 20) in order to provide the smallest possible passing window for the work piece (1) against the lifting cylinders (9). Thus, only the pressure in the piston bodies (19, 21) against the deburring pistons (4) will be effective during the deburring procedure.

A rotation drive (25) and a rotation stop are located on the swivel bearings (18, 20) in order to set or to limit the setting angle between the deburring pistons (4) and the work piece (1). The drive could also be used to rotate the piston bodies (19 or 21 respectively) into a repair or cleaning position.

Figure 4:
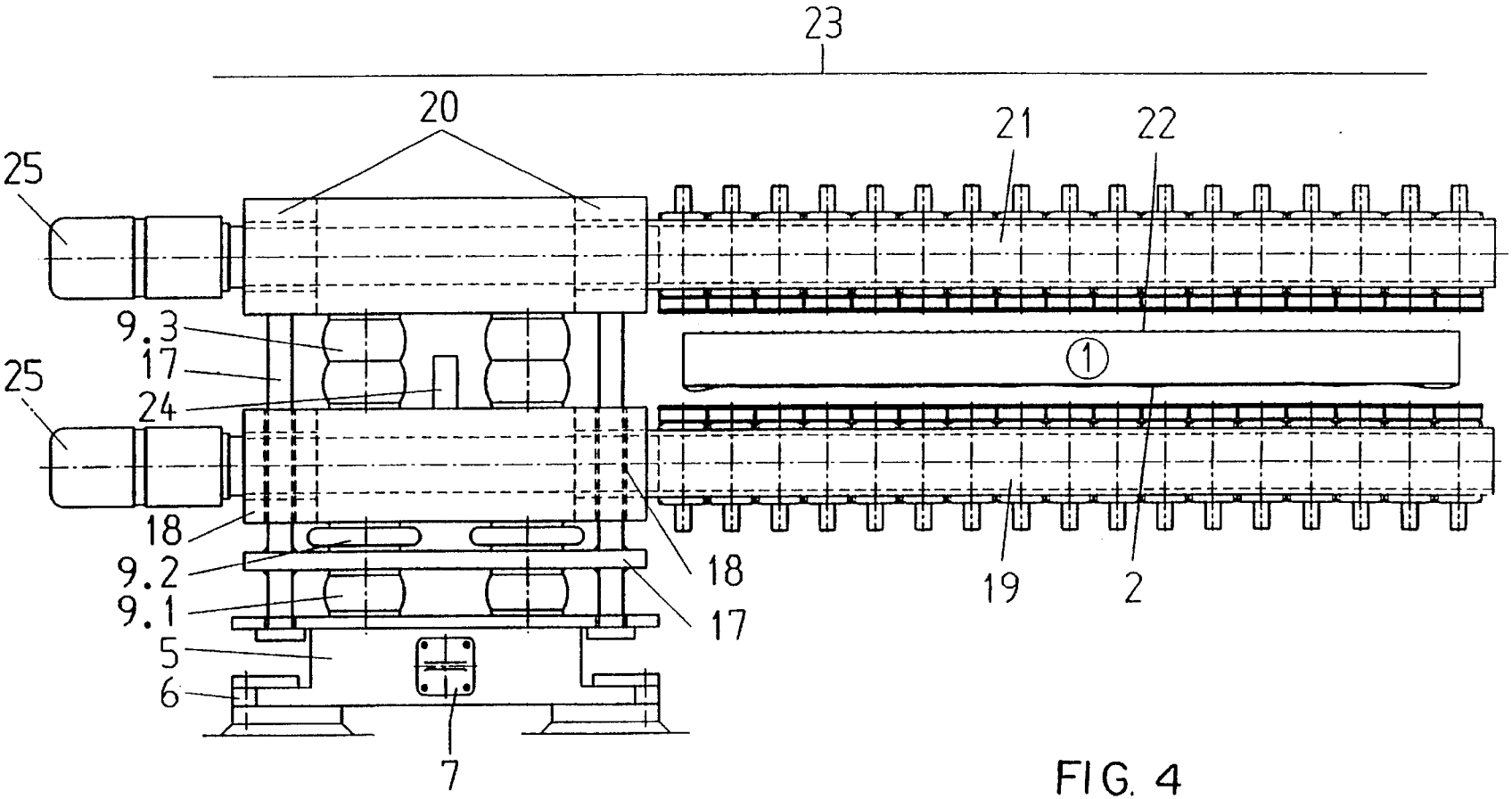
FIG. 4 is a side elevational view of a deburring apparatus similar to that of FIG. 3 showing a cantilever design with a piston body and associated deburring pistons above and below a work piece.

FIG. 4 illustrates a deburrer (23) similar to that shown in FIG. 3, except a cantilever design is used which could be arranged unilaterally, but which will require more space at that side.

Figure 5:
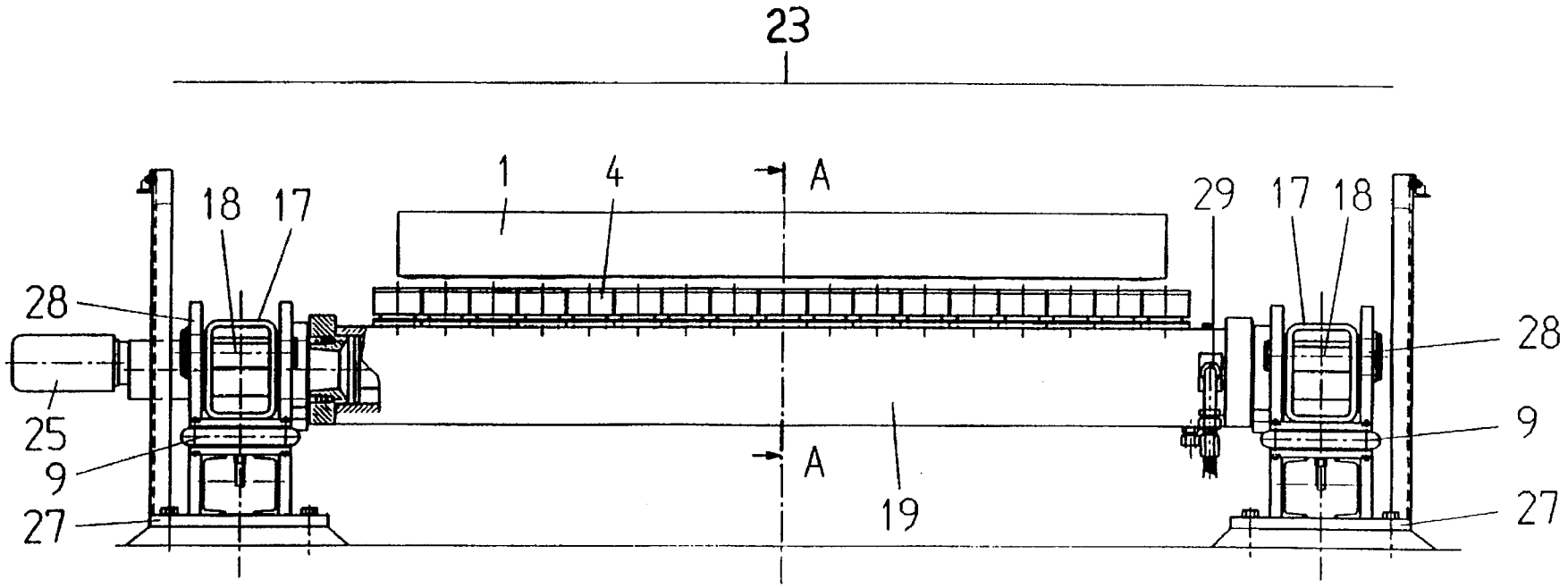
FIG. 5 is a side elevational view of a deburring apparatus showing a piston body and deburring pistons below a work piece.
Figure 6:
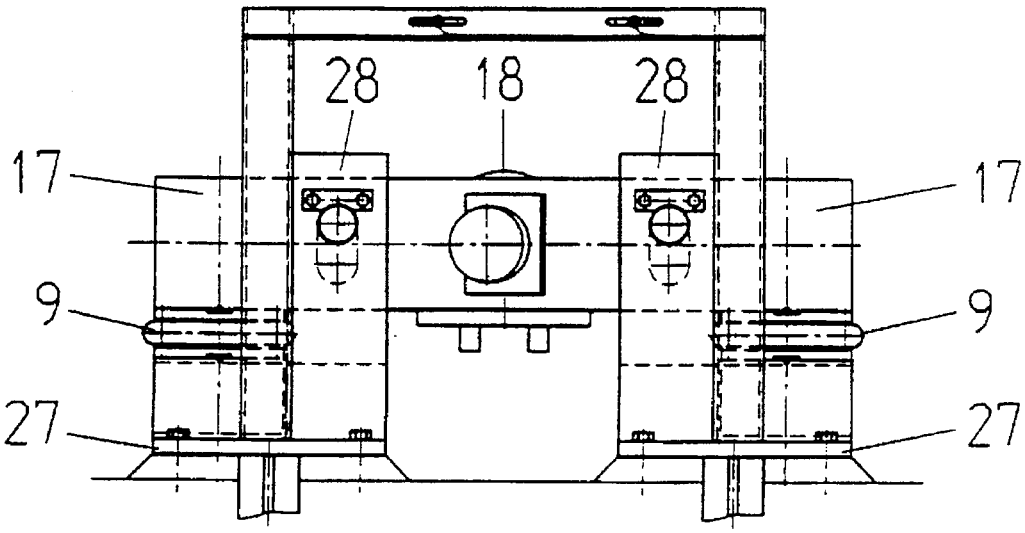
FIG. 6 is a front elevational view of the deburring apparatus shown in FIG. 5.
Figure 7:
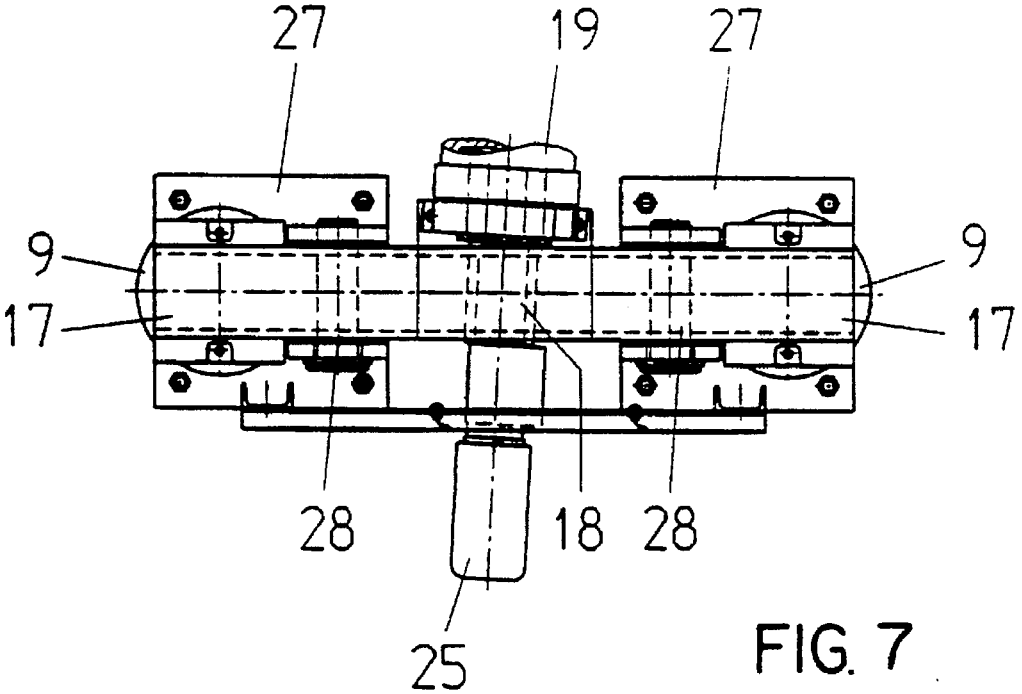
FIG. 7 is a plan view of the deburring apparatus shown in FIG. 5.

FIGS. 5, 6 and 7 illustrate a front view, a side view, and a top view of the bearing side of a simplified deburrer (23), i.e., only consisting of swivel bearings (18) at both sides, arranged in lifting frames (17) at both sides, liftable from the base plates (27) via four lifting cylinders (9), with lifting guides (28) for the piston body (19).

When the work piece (1) is pushed over the piston body (19), this deburrer (23) will deburr in a stationary state by means of deburring pistons (4) being pushed up against the work piece (1) from below. Via an air supply pipe (29), the entire piston body (19) will be put under pressure, and all the deburring pistons (4) will be extended at the same time.

In accordance with the present invention, it is quite important that all the deburring pistons (4) are extended at a low air pressure so that they meet the lower surface of the work piece (1) to fit its shape when the piston body (19) is lifted by the lifting cylinders (9) prior to each deburring process.

Figure 8:
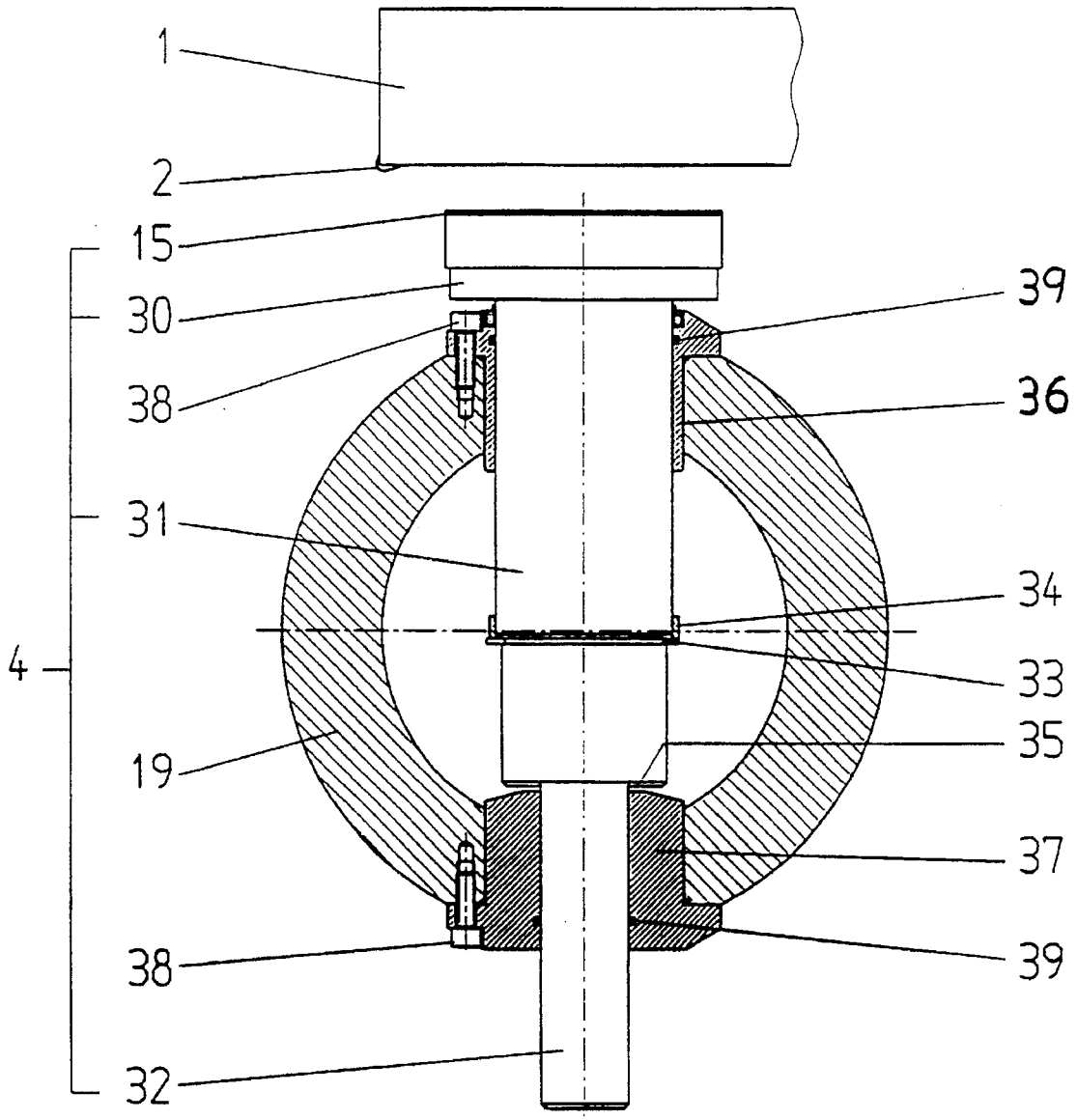
FIG. 8 is a sectional view of a deburring piston mounted in a piston body in accordance with an embodiment of the present invention.

FIG. 8 demonstrates that the piston body (19) according to the invention and which replaces to the former deburring beam (3) of FIGS. 1 and 2 is basically made of an unmachined thick-walled pipe having a hollow interior which can be pressurized to extend the deburring pistons from the piston body. To this effect, each deburring piston (4) may be manufactured as one part consisting of the shear head (30) with the cutting edge (15), the working piston (31) and the piston shaft (32), and provided with an elastic buffer ting (34) held by a spring ring (33) to prevent its being ejected from the piston body.

The surface difference between the working piston (31) and the piston shaft (32) represents an effective pressure surface (35) to press the shear head (30) against the lower surface of the work piece (1).

The deburring piston (4) is guided in the upper piston sleeve (36) and the lower piston sleeve (37) which are fixed by hexagon socket screws (38) at through bores of the piston body (19) having the same size. Sealing rings (39) in the piston sleeves (36, 37) which could equally be arranged within ring grooves at the working piston (3) or at the piston shaft (32) seal the interior space of the piston body (19) which is filled with compressed air against pressure losses as the deburring piston moves in and out.

The diameters of the various components within the deburring piston are selected in such a way that the deburring piston (4) could be pulled out completely, i.e., from one side. For this purpose, only the upper piston sleeve (36) would have to be loosened and pulled out.

Figure 9B:
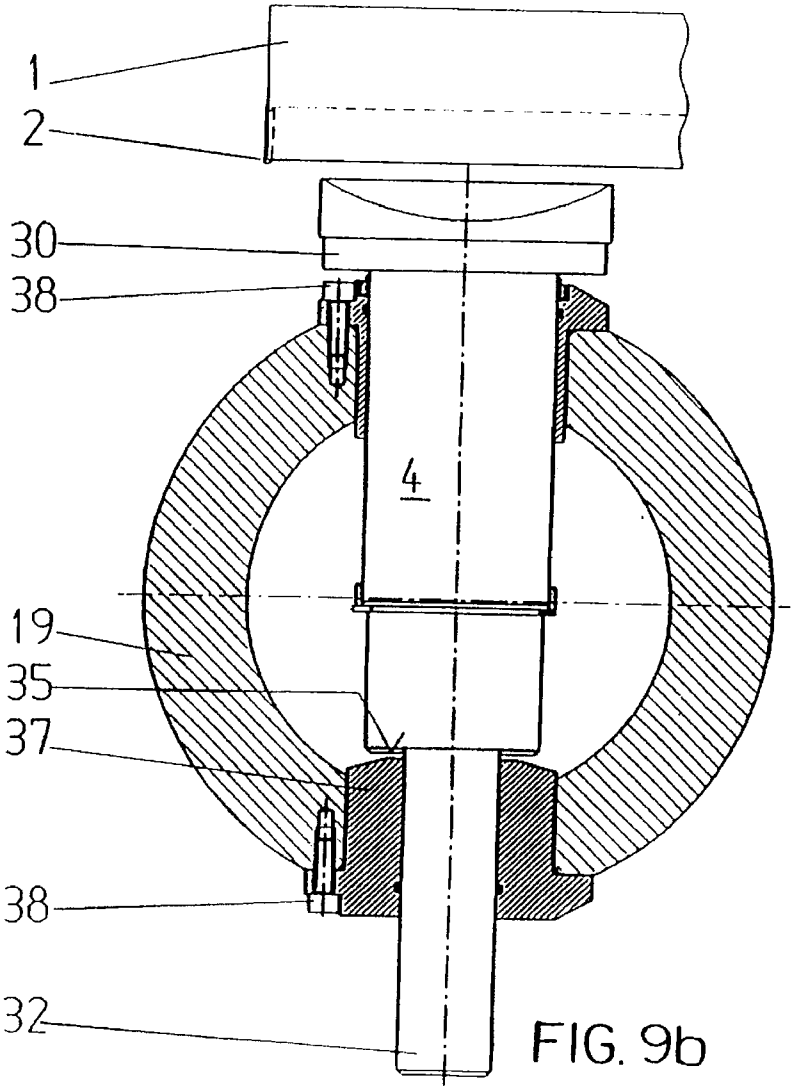
FIGS. 9*a* and 9*b* are sectional views of a deburring piston mounted in a piston body in accordance with another embodiment of the present invention.
Figure 9A:
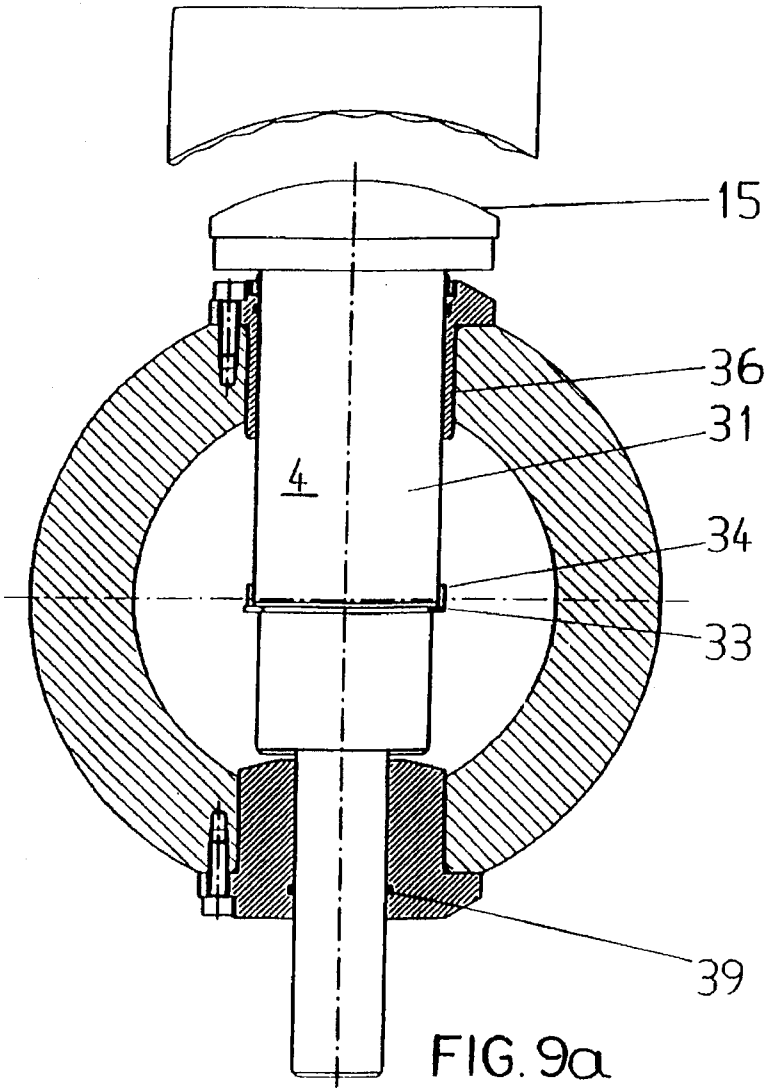
Figure 10C:
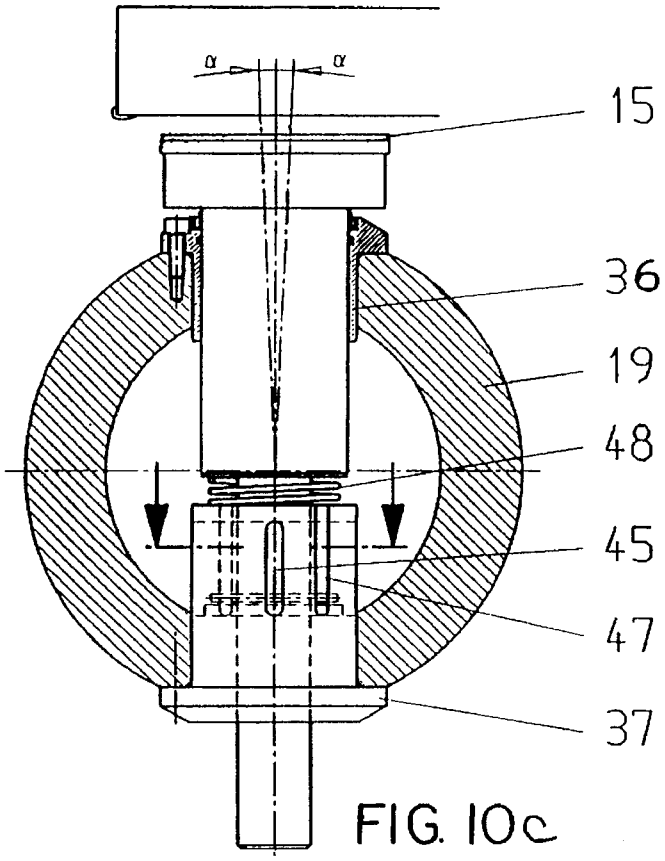
FIGS. 10*a*–10*d* are sectional views of a deburring piston mounted in a piston body in accordance with another embodiment of the present invention.
Figure 10D:
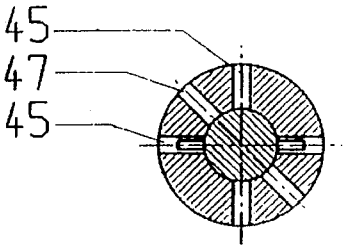
Figure 10A:
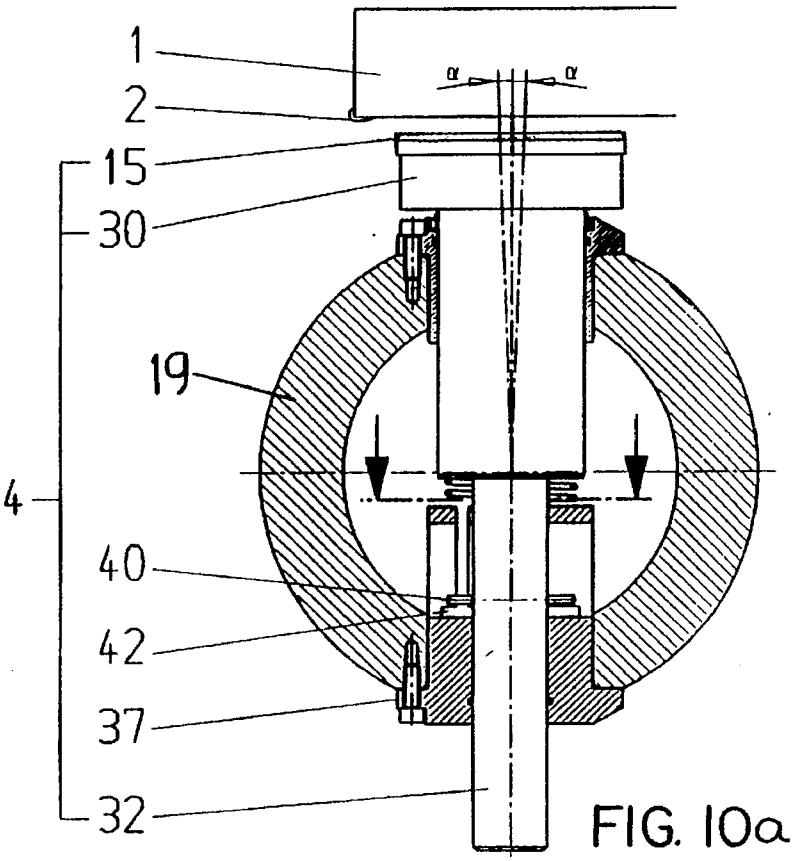
Figure 10B:
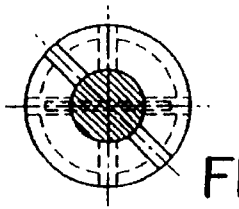

FIGS. 9*a* and 9*b* demonstrate that the shear head (30) with the cutting edge (15) is manufactured to fit into a shape either set back (concave) or projecting (convex) of the work piece (1) and to shear off a cutting burr (2) at the end of the work piece (1) by sliding the shear head (30) in or alongside of the work piece (4).

According to the invention, FIGS. 10*a*–10*d* show the deburring piston (4) described above adjusting itself by the rotatability of the piston body (19) around an angle in the direction of shearing either forward or backward against the lower surface of the work piece (1) until it reaches a rotation stop or which could be adjusted by means of a rotation drive. In this manner, the front edge of the shear head (30) and of the cutting edge (15) pushes against the lower surface of the work piece (1) with as small a surface as possible with an obtuse cutting angle of greater than 90°. Due to the round shape of the shear head, it starts pushing against the burr to be sheared off using a limited width only.

It has been confirmed by tests that the self-actuating angle adjustment of the round cutting edge (15) limited by a stop allows an essential reduction of the upward pushing force, since the limited contact area of the curved cutting edge is less influenced by the possible unevenness of the surface of the work piece (1) and hence requires a minimal shear force. It has also been found that larger setting angles $\alpha$ of about 2° and greater lead to a slip of the shear head requiring more shear force as it sticks and slips in the shearing direction due to the cutting edge (15) being pressed too deeply into the surface of the work piece (1) in front of and beneath the burr (2). Rust and scales on the surface of the work piece, as well as high temperatures, can cause increased penetration of the cutting edge (15) into the surface of the work piece (1).

Using higher setting angles, the gap between the foremost point of the cutting edge (15) and the lateral outside part of the shear head (30) over the working piece (1) could become large enough that the engagement behind the burr (2) originally contacted at the middle of the shear head (30) will no longer be effective due to a key-shaped intrusion of the burr (2) crucially changing the conditions of forces. Subsequently, there will be a state that—as demonstrated by the exemplary calculation given above—will require high upward pushing forces of the deburring piston (4) acting against the work piece (1) and the burr (2) and, hence, even higher shearing forces, in order to prevent slipping over the remaining burr but still pushing it away.

If, however, the setting angle is kept small enough, i.e., below 2°, in order to make the above-mentioned gap small enough and to avoid jerking, and the front edge of the shear head (30) is simultaneously pressed upward with the smallest contact surface in front of the burr (2) and hooked onto the burr (2), the cutting edge will be prevented from sliding onto the burr (2) such that—besides the lowest values of upward pushing forces—the lowest shearing forces and thus a calm, easy, and fast deburring will be achieved at the lowest pressure values of the operating media and component sizes.

An exemplary calculation of such a case, under the same conditions as set forth in the first calculation shown above, would have the following result:

Calculation of Deburring Force $F_E = F_S + F_R$

The vertical force component against the lower surface of the work piece (1) increasing the friction and stemming from the deburring force will not be effective.

$$\begin{aligned} F_E \max &= F_S + F_{R1} = b_S \times l_S + F_{AN} \times \mu_M \\ &= 1.5 \times 10.6 \times 800 + 480 \times 0.2 \\ &= 12720 + 96 = \underline{12816}\ \text{N} \end{aligned}$$

$F_{AN}$ = assumed pushing-up force due to successful tests = 480 N.

The shear force $F_{Emax}$ required is below the result of the exemplary calculation of the flat shear head (30) by a factor of 10.

Tests made under similar conditions as calculated showed that, in the case of a plane position with a pushing-up force of p=3.5 bar, the measured sheer forces were about 149,000N. In the case of an edged position with a pushing-up force of p=1.5 bar, the values were about 10,000N to 12,000N in order to safely deburr a width of 124 mm, and even more with a cold work piece and a cold burr (2).

FIGS. 10*a*–10*d* demonstrate how the deburring piston (4) and its guidance in the piston sleeves (36, 37) is guided according to the invention, i.e., without distortion and without being ejected, and how it can be removed manually from one side without dismantling other parts such as both of the piston sleeves (36, 37).

For this purpose, the piston shaft (32) is provided with a transversely extending position bolt (40) in the interior of the piston body (19) which is not needed for the guidance, and the lower piston sleeve (37) is extended into the inside of the piston body (19) beyond the guidance and surface pressure requirements. This extension has an inside diameter which is bigger than the diameter of the piston shaft (32) and reaches up to the guidance area. Over the bottom of that extension, the dimension being adapted to the length and the spring excursion of a position spring (48) there is a ring groove (42) in which the transversally arranged position bolt (40) can be turned. The position grooves (45) used by the position bolt for guidance are milled into the lower piston sleeve (37) up to the inside bore substantially in a crosswise manner, and are provided through the sidewall of the piston sleeve in a window-like manner. The position grooves (45) are closed at the upper end, thereby preventing the deburring piston (4) ejecting from the piston body (19) at a relevant pressure inside the piston body (19). Another pair of insertion grooves (47) extend from the upper end surface of the piston sleeve (37) as deep as the position grooves (45). The piston is inserted by aligning the position bolt (40) with the insertion grooves (47). Then a pressure is applied to the deburring piston (4) against the position spring (48), so that the bolt (40) is lowered to the height of the ring grooves (42). Then by rotating the piston, the position bolt (40) is brought under the position grooves (45). Removing the applied pressure from the deburring piston (4), will cause the position bolt (40) to rise within the position groove (45) which is closed at the top.

The deburring piston (4) is removed by applying a pressure against the position spring (48), pushing the position bolt (40) into the ring groove (42) and then turning it under the insertion groove (47).

Referring to FIGS. 11*a*–11*c*, it can be seen that only about the lower half of a deburring piston (4) in the piston body (19) with a lower piston sleeve (37) is shown. This is another way of inserting the deburring piston (4) into a position groove (45). The position ring (41) which is equipped with position springs (48) at its lower side and provided at the surface with position flutes (43) for the desired insertion and working positions of the position bolt (40) rests on the bottom of the extension of the lower piston sleeve (37). The upper side equipped with flutes (43) projects into the ring groove (42), thus preventing a distortion of the piston shaft (32) by torsional forces generated by the position bolt (40). The position ring (41) is secured against movement by at least one position ring pin (44) which is screwed onto the position ring. The position ring pin (44) may travel in the existing position groove (45) for the longitudinal guidance of the piston shaft (32) or by means of a holding groove of its own. For this purpose, these components have to reach sufficiently far below the ring groove (42).

The position bolts (40) and the piston shaft (32) are pushed down with the position bolts (40) riding in the insertion grooves (47) up to the elastic position ring (41). The piston shaft (32) is then rotated into engagement with the desired flutes (43) to give the piston shaft (32) and the position bolt (40) the desired position under the position grooves (45). With the air pressure in the piston body (19) rising, the deburring piston (4) will then be lifted up and the position bolt (40) will be lifted into its position grooves (45), if necessary, up to their upper end. Upon depressurization, the deburring piston (4) will go down again, and can be rotated to align with its position bolt (40) under the insertion grooves (47) and pulled out.

In the case of a deburring piston (4) which hangs down or which has insufficient weight to reset upon the release of pressure, the deburring piston (4) may be biased by a push-back spring (49) at the outside end of the piston shaft (32) by means of a push back cover (50), in order to push the piston back into its home position. In addition, a protection cap (51) can be applied at the outside of the piston sleeve (37).

Figure 12:
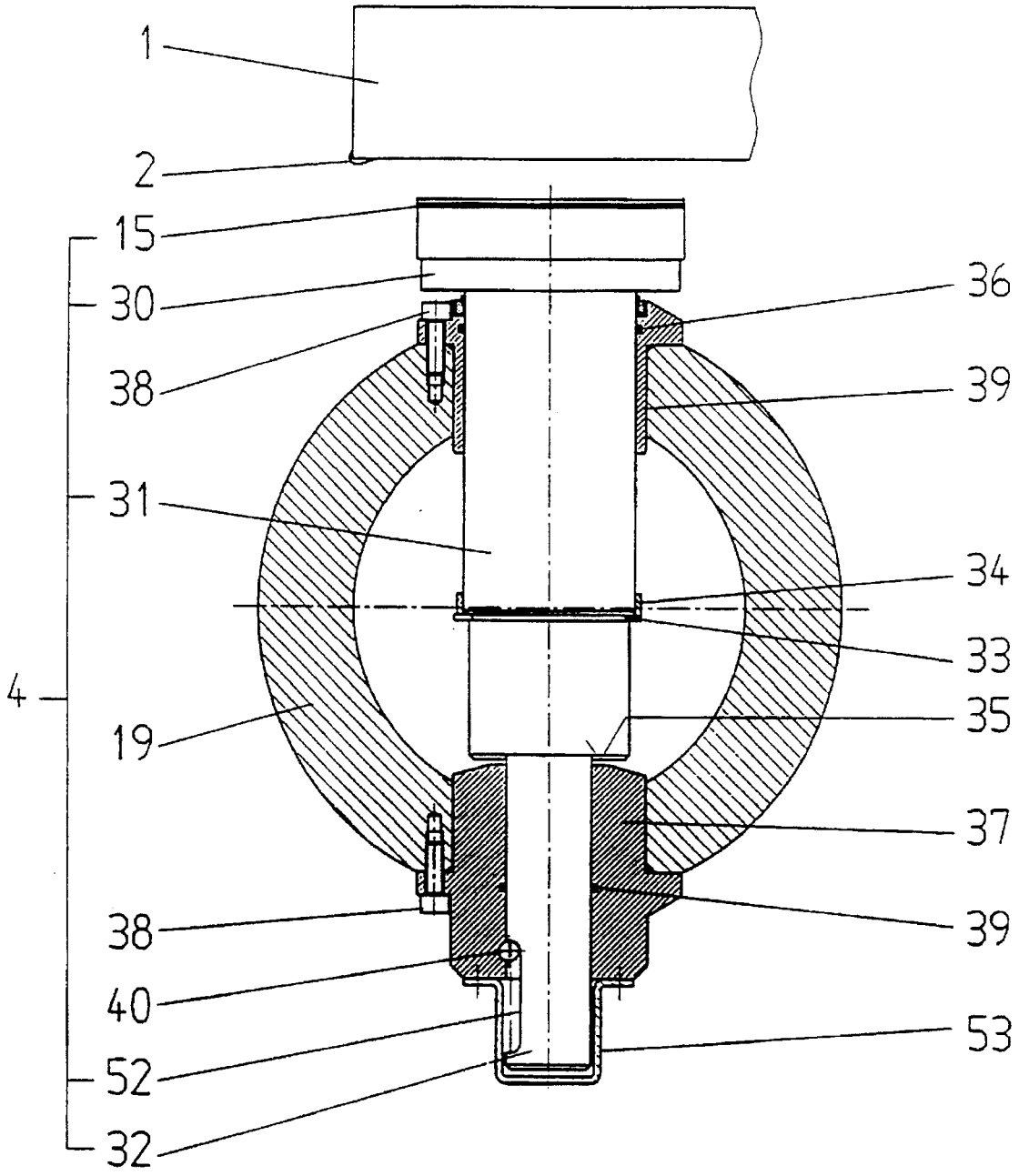
FIG. 12 is a sectional view of a deburring piston mounted in a piston body in accordance with another embodiment of the present invention.

FIG. 12 illustrates a deburring piston (4) having a piston shaft (32) with a milled-in guide surface (52) outside of the working area or sealing-area and partially within the part of the lower piston sleeve (37) which is located outside of the piston body (19). This guide surface (52) engages with a position bolt (40) in the lower piston sleeve (37) and prevents distortion and ejection of the deburring piston (4) from the piston body (19). The only disadvantage of this simple and cheaper assembly is the fact that for the purpose of removing the deburring piston (4), the position bolt (40) at the lower side has to be removed first. A cover (53) prevents injuries while travelling the deburring piston (4) into and out of the piston sleeve (40).

Figure 13A:
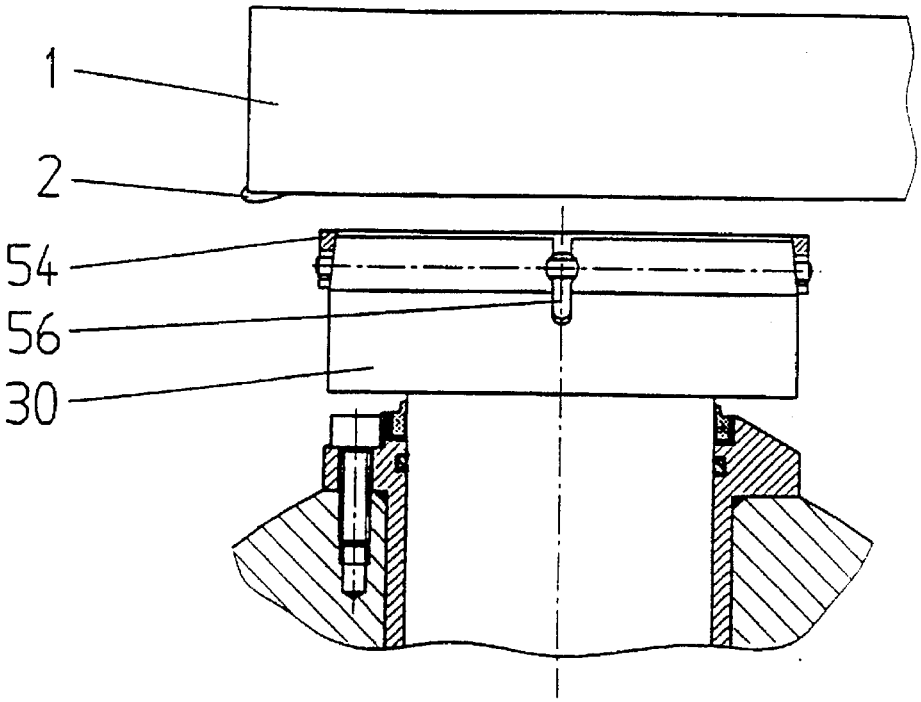
FIGS. 13*a* and 13*b* are sectional views of a shear head of a deburring piston.
Figure 13B:
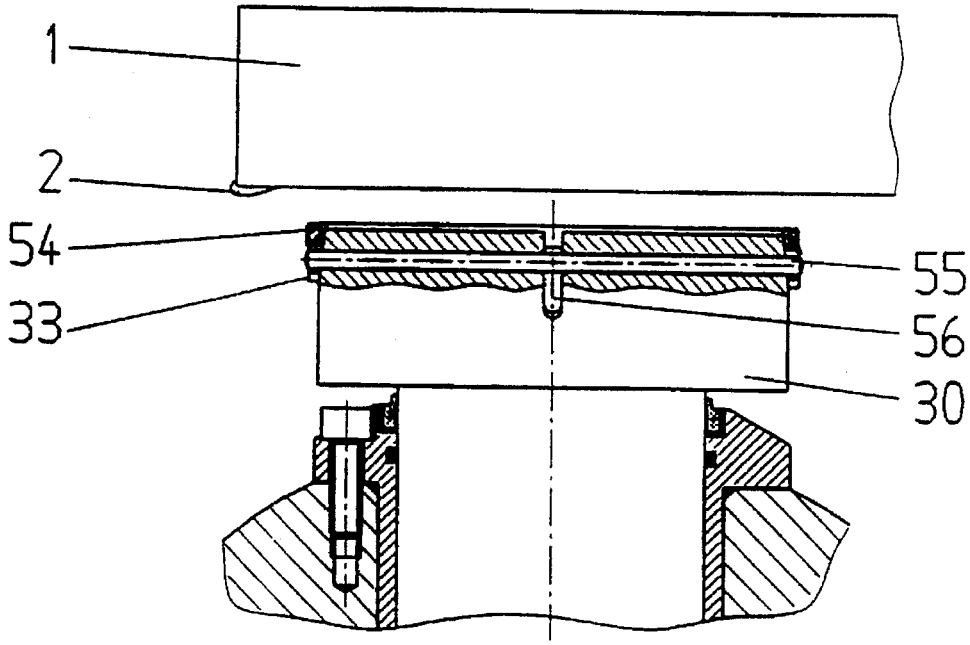

As shown in FIGS. 13*a* and 13*b*, certain measures may be used to prevent wear of the shear head (30). For example, a shear ring (54) acting as a cutting edge (15) and equipped at the inside with a fitting cone may be located on a conically machined shear head (30). The shear ring (54) is secured by a pin (55), but for the purpose of being replaced, it can be detached by means of a customary cotter key (not shown) via the groove (56) upon removal of the pin (55).

Figure 14:
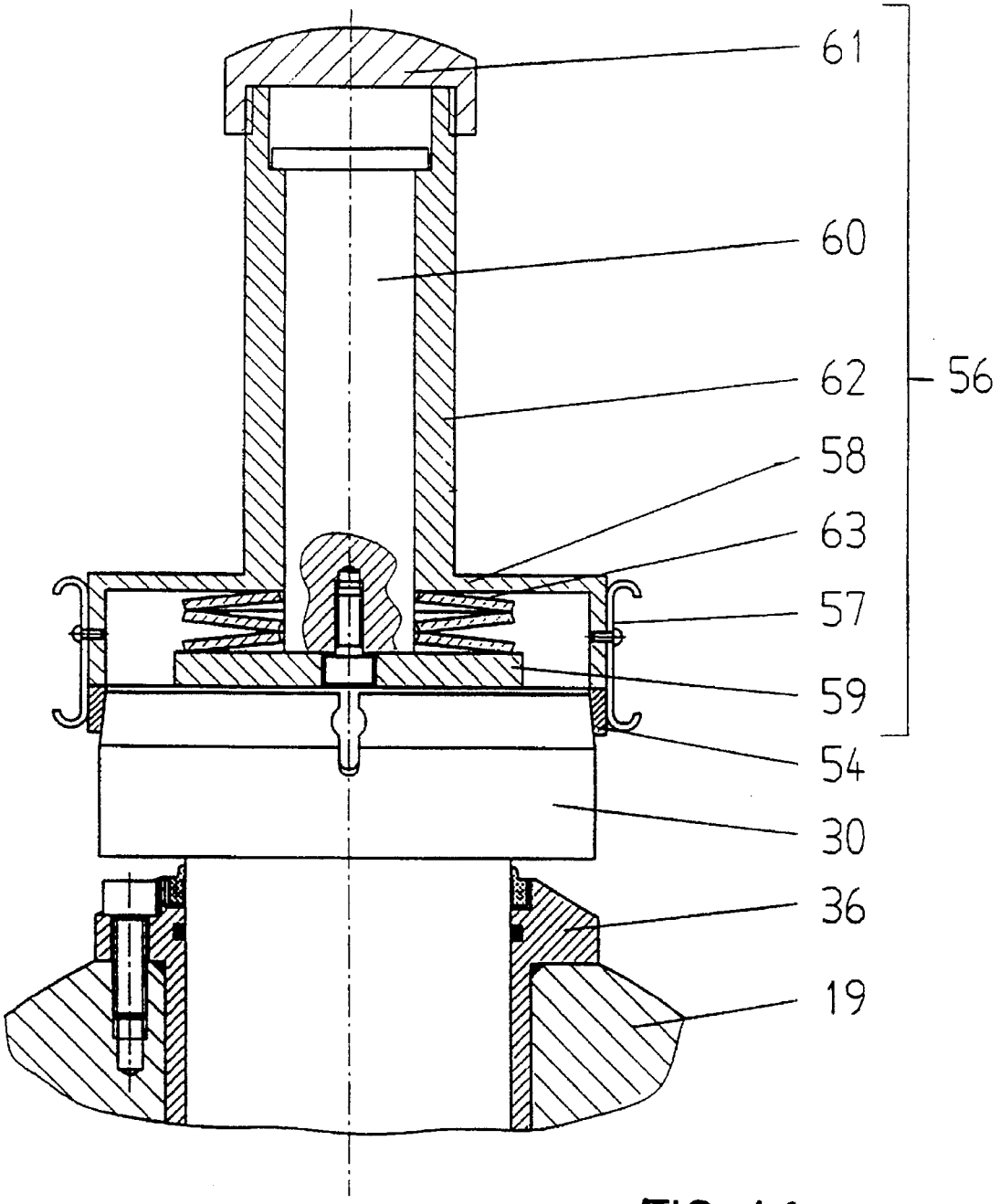
FIG. 14 is a sectional view of an apparatus for mounting a shear ring on a shear head.
Figure 15A:
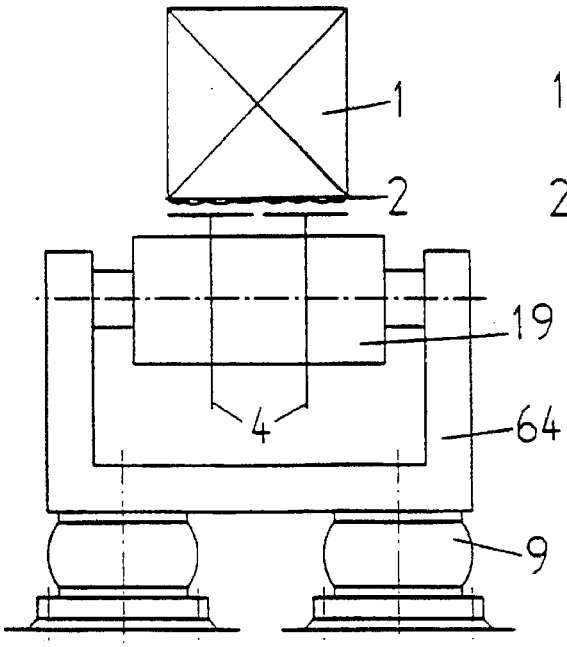
FIGS. 15*a* and 15*b* are side and front elevational views, respectively, of a deburring apparatus including a rotatably mounted piston body.
Figure 15B:
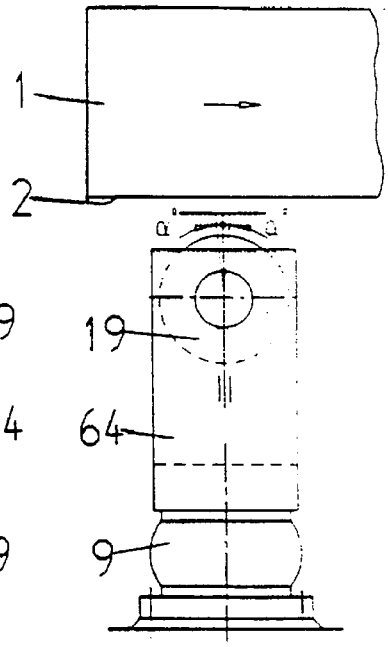
Figure 15C:
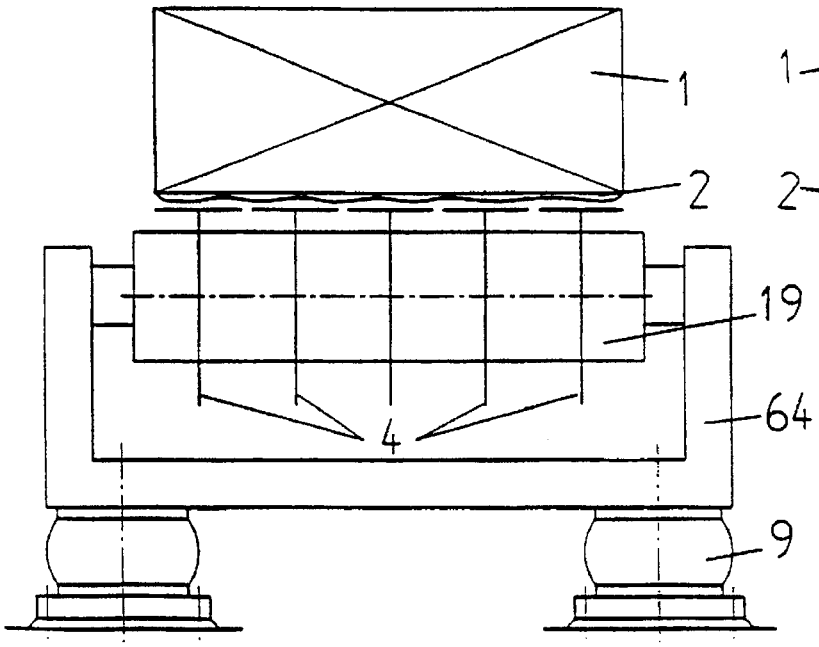
FIGS. 15*c* and 15*d* are side and front elevational views, respectively, of a deburring apparatus including a rotatably mounted piston body.
Figure 15D:
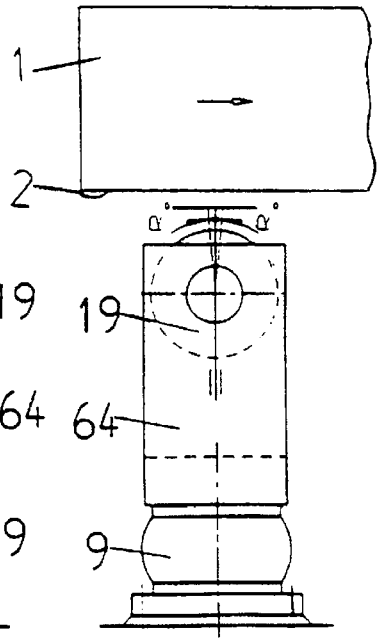

FIG. 14 shows a shear ring setter (56) tool. The shear ring (54) is held smoothly and squarely at the lower edge of the setter case (58) by means of the clamps (57). The shear ring setter (56) is placed onto the shear head (30) with its setter plate (59) and setter piston (60). Hammer strokes onto the stroke cover (61) of the piston bush (62) will push the shear ring (54) against the spring (63) at the truncated cone of the deburring piston (30).

The basic design of a simple deburrer (23), e.g., for square or rectangular blooms, is demonstrated in FIGS. 15*a*–15*d*. Below the work piece (1) with the cutting burr (2), there is a piston body (19) with a number of necessary deburring pistons (4) pivoted in the direction of deburring at a desired angle. The piston body (19) is supported by a case (64) which is mounted on lifting cylinders (9) and which is lifted against the work piece (1) at the beginning of the deburring procedure.

Figure 16B:
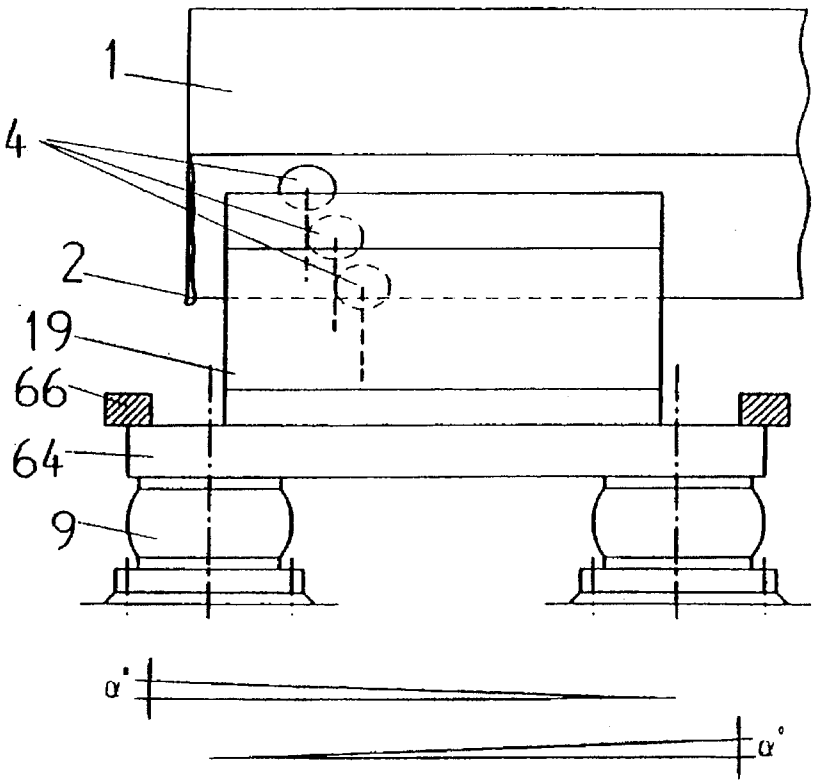
FIGS. 16*a* and 16*b* are side and front elevational views, respectively, of a deburring apparatus and an angled work piece.
Figure 16A:
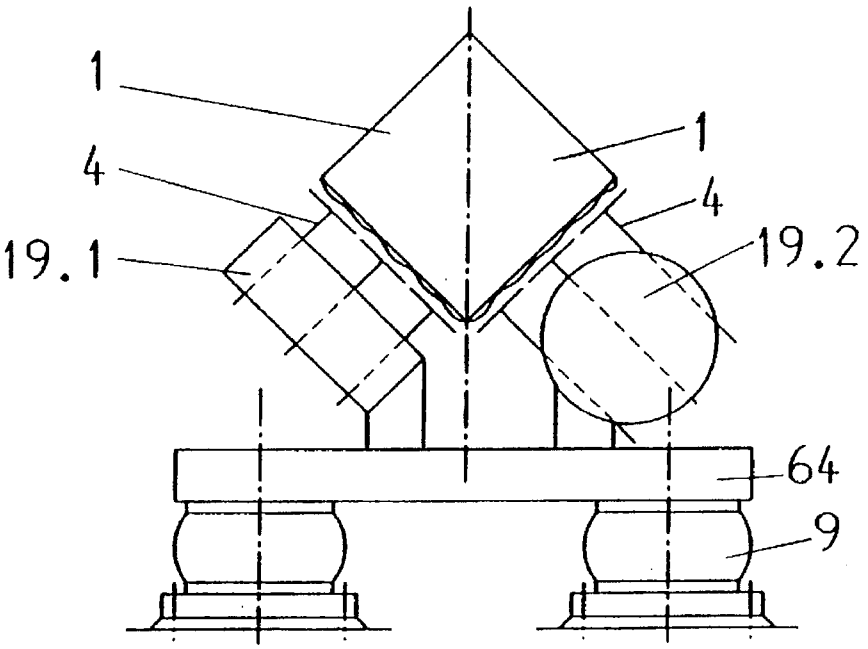

FIGS. 16*a* and 16*b* show a work piece (1) positioned at an angle. The work piece (1) has a square cross section and includes cutting burrs (2) located at two edges positioned at a slant angle. The deburring pistons (4) are arranged at a slant angle one after another in the direction of deburring, and are disposed in suitably designed bilateral piston bodies (19.1 or 19.2 respectively). The piston bodies are solidly fixed to a base plate (64). Lifting of that base plate by lifting cylinders (9) against stops (66) prior to the deburring process provides the desired set angle for the deburring pistons (4) arranged one after another.

Figure 17B:
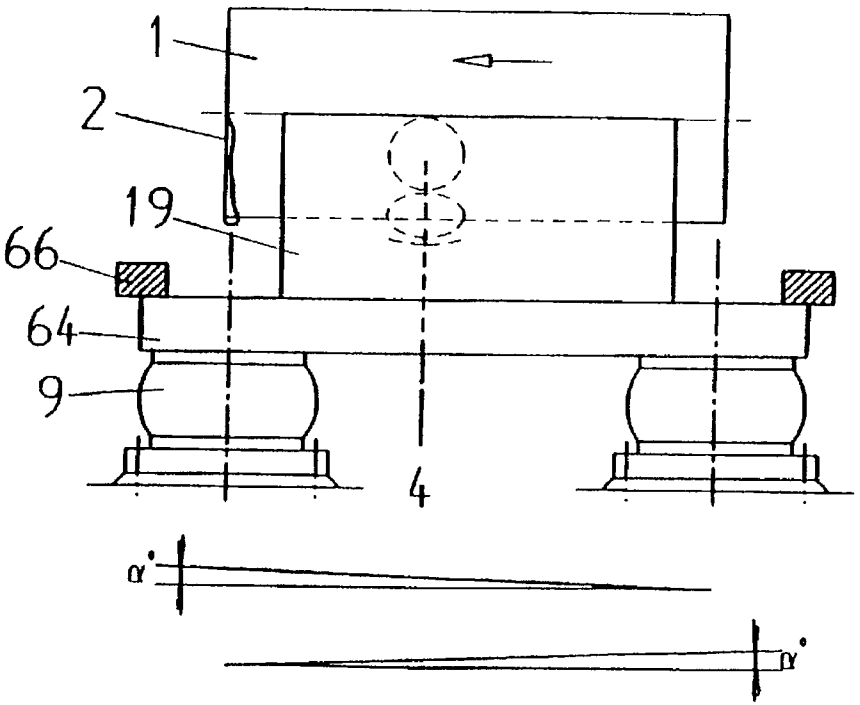
FIGS. 17*a* and 17*b* are side and front elevational views, respectively, of a deburring apparatus and a round work piece.
Figure 17A:
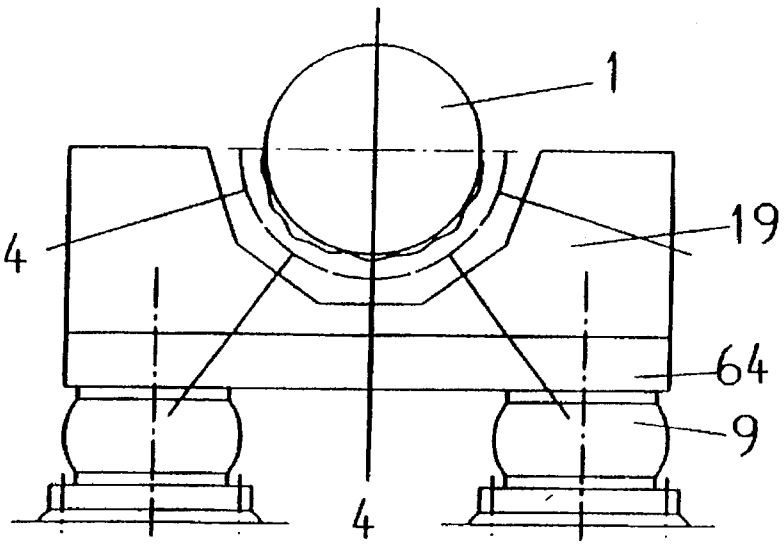

As shown in FIGS. 17*a* and 17*b*, the present invention includes a deburrer (23) for round work pieces (1). For this purpose, the piston body (19) and the position of the deburring pistons (4) have been modified. Since the deburring pistons (4) are arranged one after another, they can overlap so that they can be used for several adjacent diameter sizes of the work pieces (1).

Figure 18A:
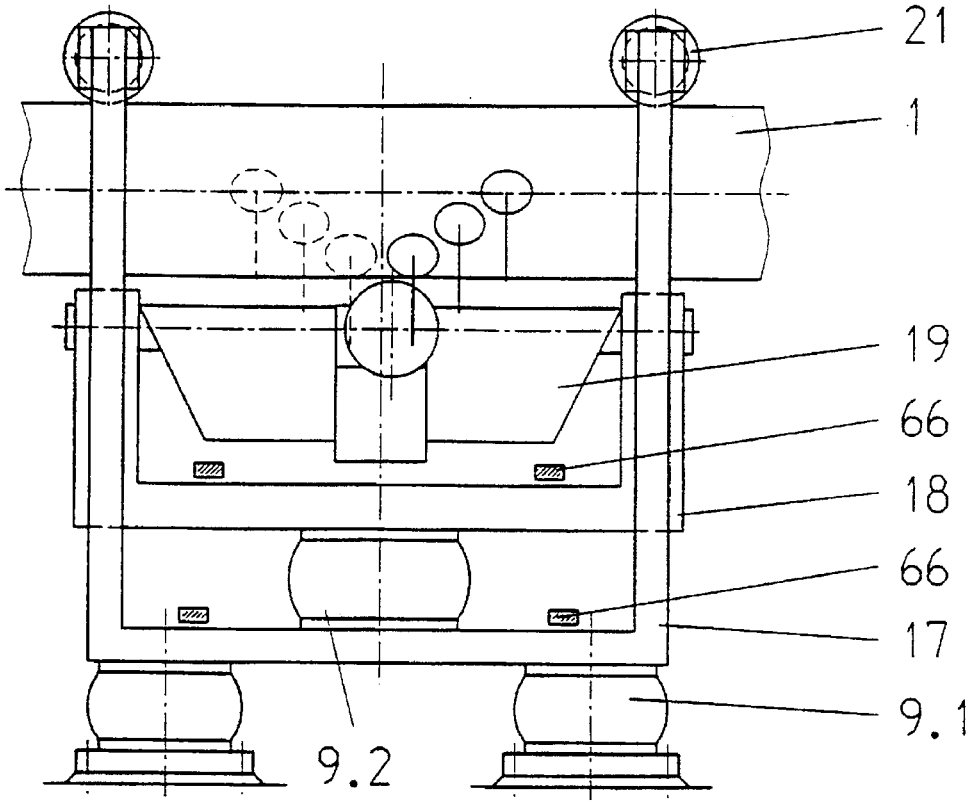
FIGS. 18*a* and 18*b* are front elevational and plan views, respectively, of a deburring apparatus and a round work piece.
Figure 18B:
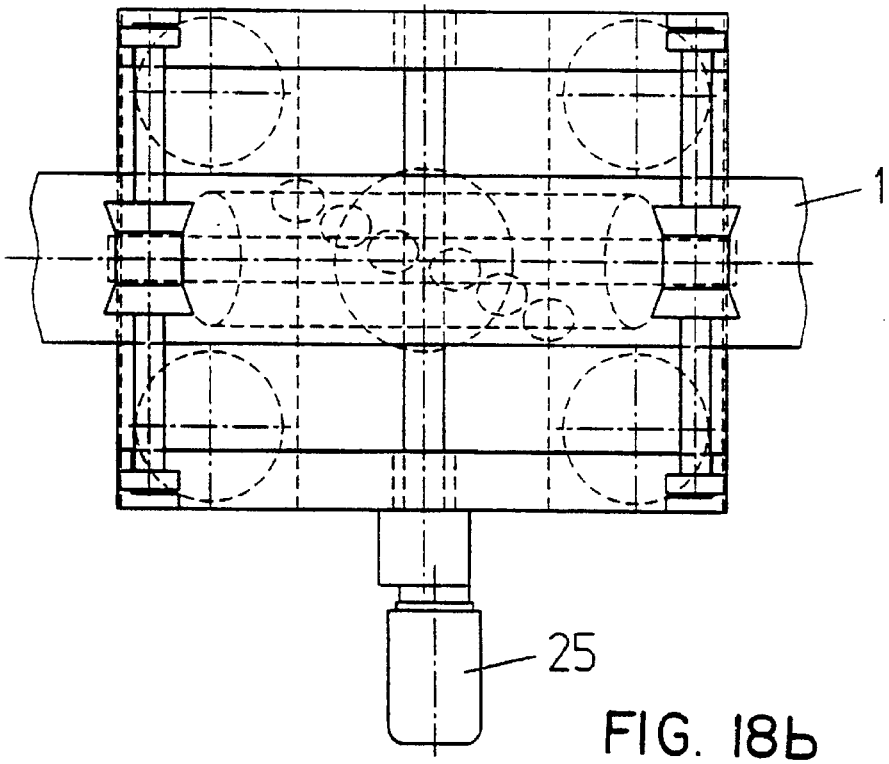

FIGS. 18*a* and 18*b* show a similar modification wherein a deburrer for round work pieces (1) is illustrated with a support structure. A lifting frame (17) resting on four lifting cylinders (9.1) carries one or several lifting cylinders (9.2) and a double swivel bearing (18) which is slidable on the lifting frame (17) and longitudinally or transversely arranged to the work piece (1). A piston body (19), equipped with the deburring pistons (4) or possibly a rotation drive (25) or a rotation stop (not shown) rests on this swivel beating (18). One or two hold-down rolls (21) are located at the upper end of the lifting frame (17). As equalizers of forces, these rolls will be pulled downwards to the working piece (1) by the lifting cylinder (9.2) when the swivel bearing (18) with the piston body (19) and the deburring pistons (4) arranged around the work piece (1) within the area of a cutting burr (2) are lifted. Subsequently, the deburring pistons (4) are moved into position against the work piece (1) and adjusted at a suitable operating angle as required, either by a rotation drive (25) or by rotation due to friction against rotation stops (not shown).

Using stops (66), the lift of the swivel bearing (18) or the lifting frame (17) could be limited in the upward direction. Such a limitation of the lift could also be used in order to preset an operating angle into the deburring direction for the deburring pistons (4).

Figure 19A:
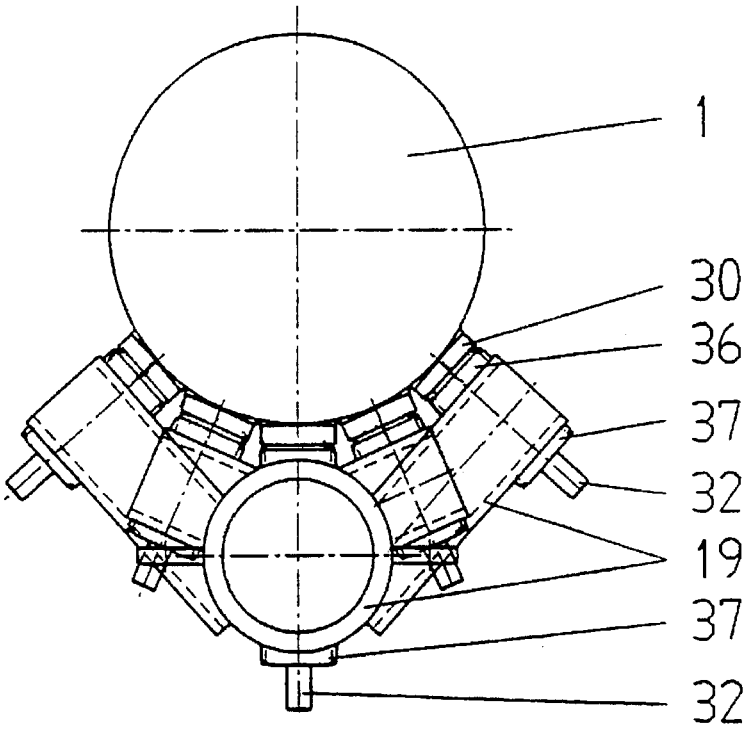
FIGS. 19*a* and 19*b* are side elevational and plan views, respectively, of a piston body and deburring pistons for a round work piece.
Figure 19B:
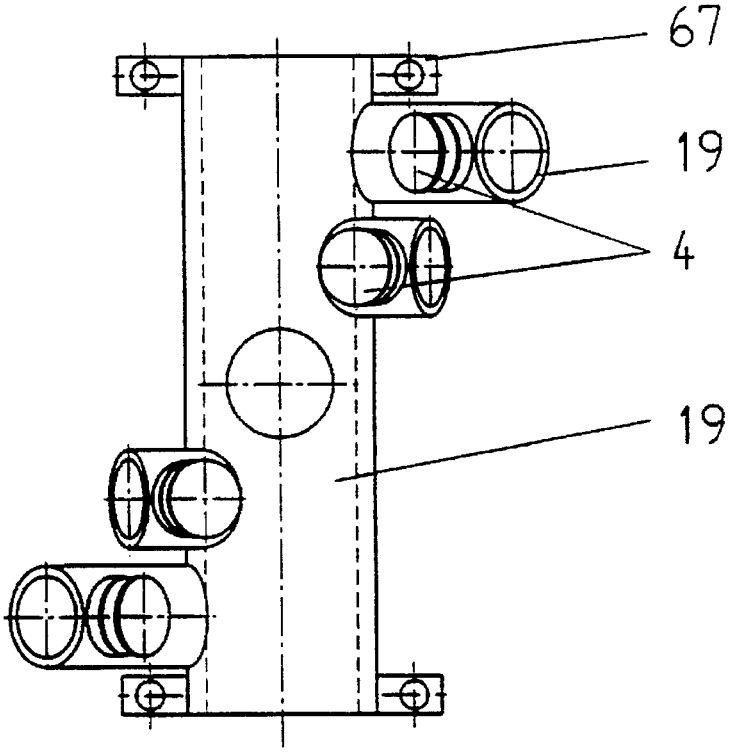

FIGS. 19*a* and 19*b* show a piston body (19) with deburring pistons (4) which can be removably mounted on a swivel bearing by means of four holding straps (67), in case of a change of the geometry of the work piece.

The piston body (19) consists of several pipes which are welded together and hermetically sealed. The arrangement of the pipes corresponds to the relevant required position of the deburring pistons (4). The surface of the shear rings (54) or the shear heads (30) respectively of the deburring pistons (4) are matched to the diameter of the work piece (1).

Figure 20C:
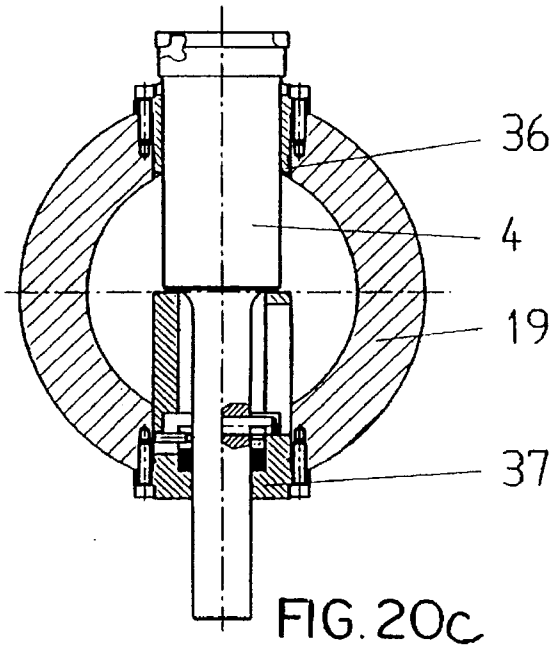
FIG. 20*c* is a sectional view of a deburring piston mounted in a piston body in accordance with an embodiment of the present invention.
Figure 20A:
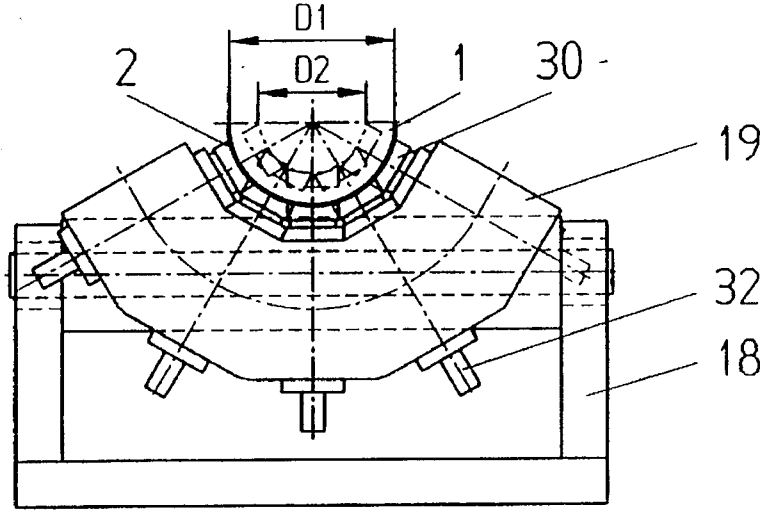
FIGS. 20*a* and 20*b* are side elevational and plan views, respectively, of a piston body and deburring pistons for a round work piece.
Figure 20B:
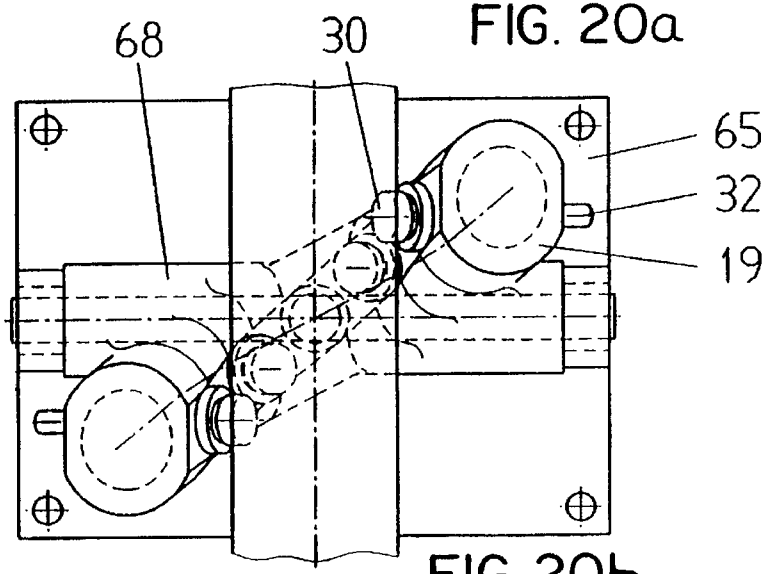

FIGS. 20*a*–20*c* illustrate another embodiment wherein the piston body (19) comprises a cast iron or steel case of a more economical and space saving design which may comprise holding straps (not shown) or axil retainers (68) for rotatable suspension.

The size of the piston body (19) is determined by the number and size of the deburring pistons (4), the diameter range of the work pieces (1), and the area of cutting burrs (2). While the area of cutting burrs can generally be assumed to correspond to the lower central 120° area of the round section, there will be a restriction to the diameter range of work pieces (1), determined by the diameter of the shear heads (30) and shear tings (54) and their shape adapted to the round shape of the work piece (1). A shear head (30) designed and shaped to fit a bigger diameter $D_1$ of a work piece (1) could also be attached in an overlapping manner to the surface area of a smaller work piece by a successive arrangement of the deburring pistons (4). However, the shear head (30) will contact the smaller work piece (1) only at a central point of its suspension, whereas its outsides will remain separated from the surface of the work piece (1) by a measure x which will determine the difference in the diameter of the biggest and smallest work pieces (1) to be handled by a shear head of given geometry.

If the cutting burr is adequately positioned and shaped, the distance x may correspond to the distance of a shear head (30) having a diameter of 120 mm and pushed against a plane surface at less than an angle of 0.2° to 2°, so that it is only influenced by the material and temperature of the cut work piece (1) and the cutting method. Routine experimentation will determine the proper distance that prevents the shear head (30) from sliding up onto the cutting burr (2), thereby eliminating the requirement of excessive forces. Based on that distance, the diameter of the smallest work piece (1) as compared to the biggest one can easily be determined geometrically. For other diameter ranges, the assembly may be modified to provide the appropriate position, number, diameter, and lift distances of the deburring pistons (4).

As in the case of flat products, an inclined setting of the deburring pistons (4) by 0.2° up to 2° to the lower surface of a work piece (1) could also be adopted for the lowest deburring piston (4). Depending on the position of the rotational axis of the piston body (19), however, the deburring pistons (4) arranged at a higher level will move less intensely towards the rotational axis. On the other hand, there will be a slight curvature where the shear head (30) contacts the surface of a crowned work piece. The cutting burrs (2) in those areas tend to be weaker and can be removed more easily.

Figure 21B:
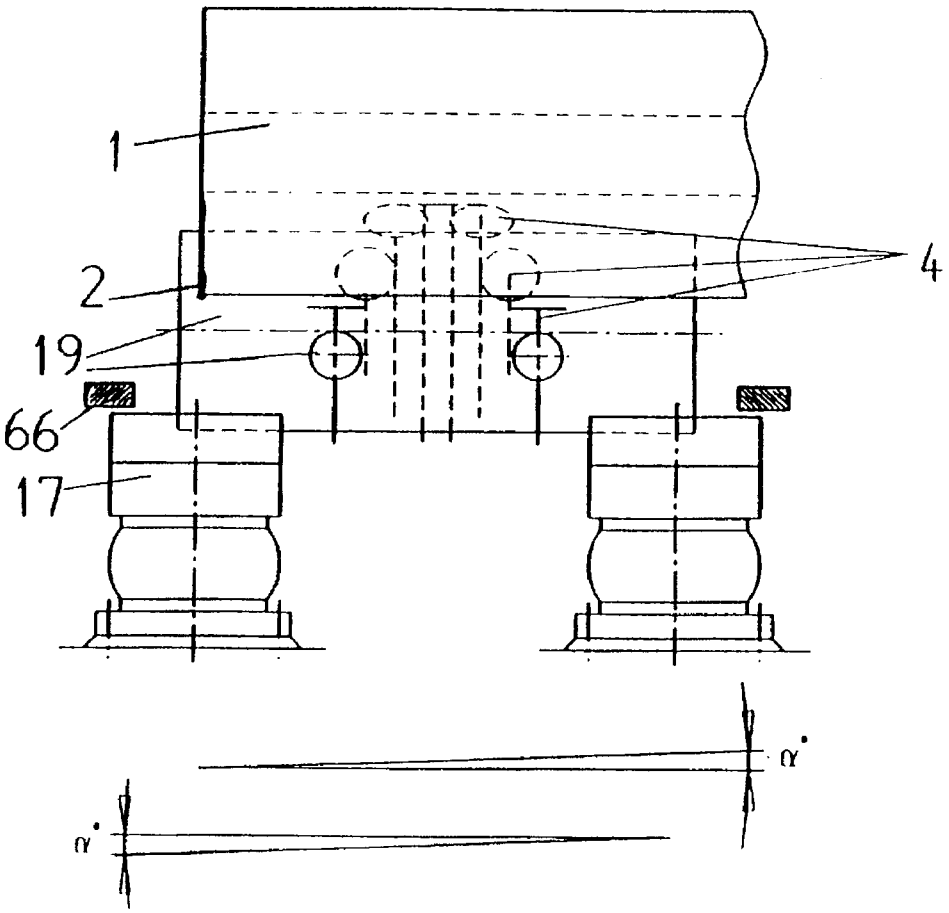
FIGS. 21*a* and 21*b* are side and front elevational views, respectively, of a deburring apparatus and a webbed beam work piece.
Figure 21A:
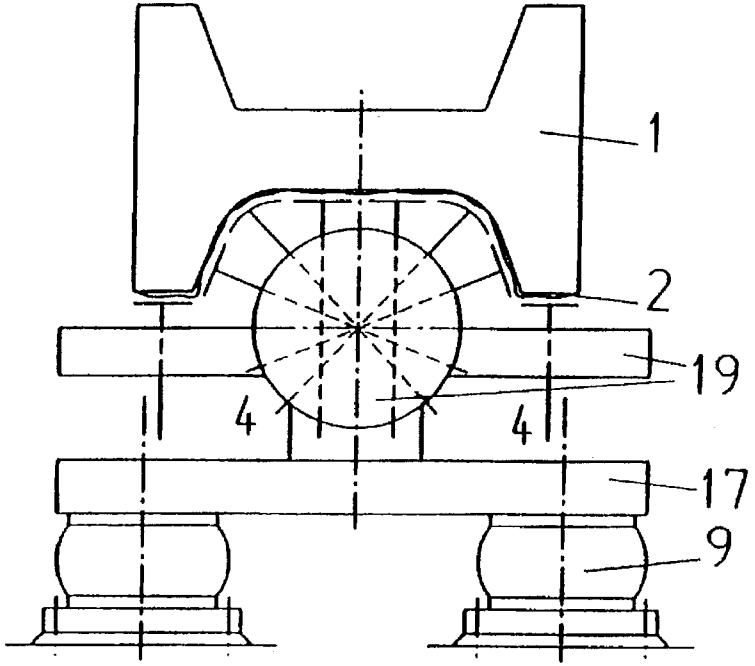

The deburrer of the present invention may also be used for work pieces (1) with a horizontal double T profile as shown in FIGS. 21*a* and 21*b*. As in the case of the round work pieces (1), the deburring pistons (4) are oriented upward in a vertical or inclined manner. For the plane surfaces at the lower sides and their inclined inner sides of the vertical flanges and at the lower surface of the web, customary cylindrical shear heads (30) with flat tops may be employed, whereas in the rounded edges between the web and flange, rounded shear heads (30) may be used. The adjustment of the setting angle $\alpha$ of the deburring pistons (4) from 0.2° to 2° into both operating directions forward and backward for front end and cutting burrs (2) is provided by piston stops (66) having positions which can optionally be changed.

Figure 22:
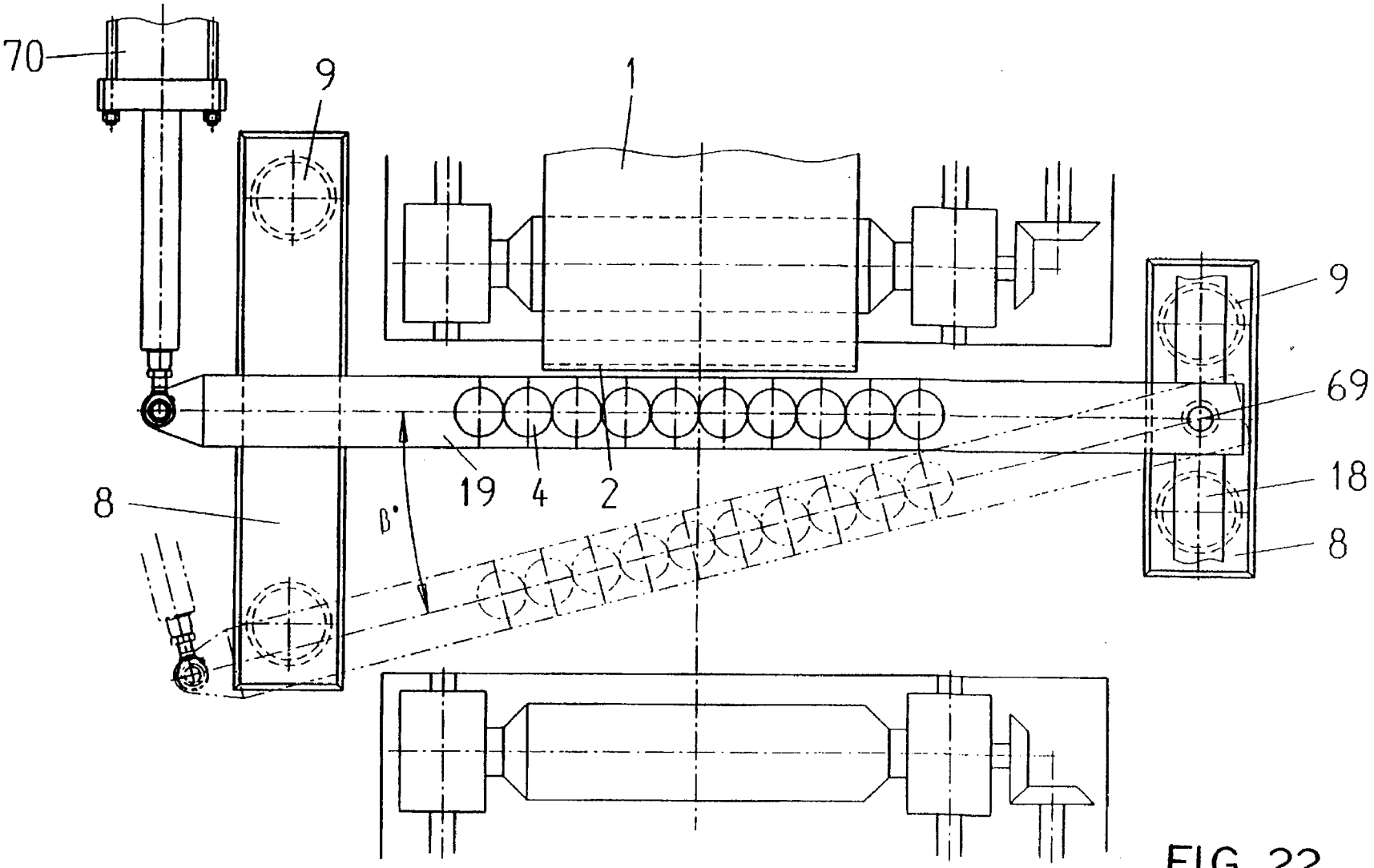
FIG. 22 is a plan view of a deburring apparatus including a pivotable piston body.

Besides being removed by a parallel shifting of the piston body (19) over flat work pieces (1), e.g., slabs, transverse burrs can be removed by angling the piston body (19) below a work piece (1) using a swivel bearing (69) and swivel drive (70) at the main frame, as demonstrated in FIG. 22.

In this embodiment, it is only important that the angle β covers possible position differences of the cutting burr (2) at the side of the swivel bearing (69).

Figure 23A:
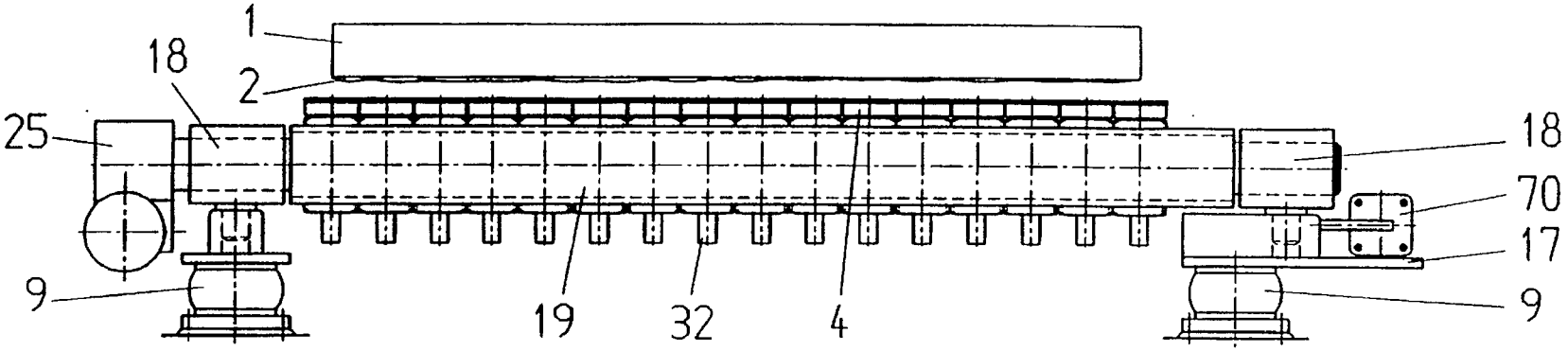
FIGS. 23*a* and 23*b* are side elevational and plan views, respectively, of a deburring apparatus including a pivotable piston body.
Figure 23B:
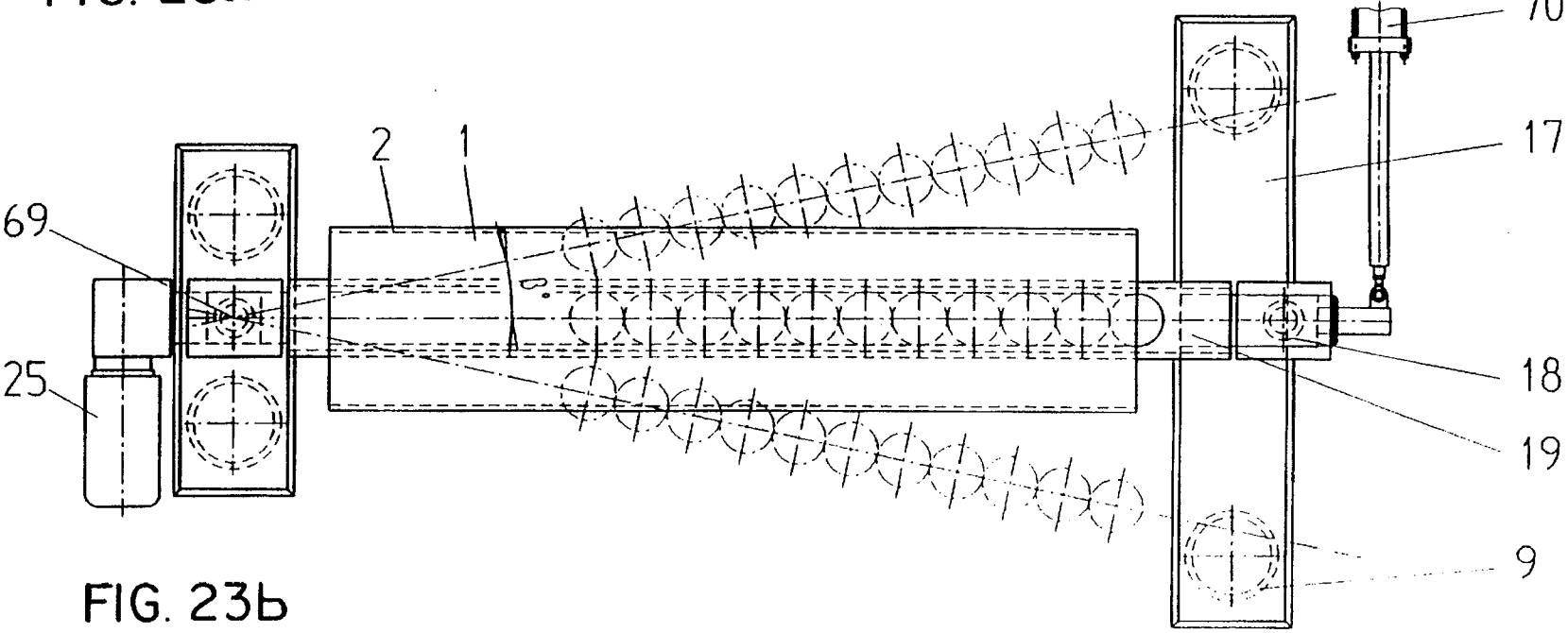

As shown in FIGS. 23*a* and 23*b*, longitudinally arranged cutting burrs (2) occurring during the longitudinal slitting of slabs due to flame-cutting could be removed by the deburring system of the present invention.

For this purpose, swivel bearings (69) and swivel drive (70) of the longitudinal slitting deburrer are positioned under the longitudinal central axis of a work piece (1) having a cutting burr (2) at both sides. Upon lifting the main frames by means of the lifting cylinders (9) and extending the deburring pistons (4) first to one side and then to the other side, one section of each cutting burr (2) could be sheared off at each side. A new deburring cycle starts upon lowering the deburrer and further pushing on the work piece (1) in a step-wise fashion.

In accordance with conventional practice, it is not necessary to take measures at the cutting burr (2) to keep the work piece (1) in its position when deburring with low forces, e.g., during flame-scarfing off, flame-cutting off, knocking off or chiseling off. It is also known that when deburring with higher forces, such as pushing off and shearing off, the work pieces (1) have to be kept fast either by means of a combined hold-down/stop device or by means of a set of driving rollers in the form of a rolling stand which pinches the work piece (1) in order to hold it securely and move it at the rotation speed of the rollers.

Figure 24:
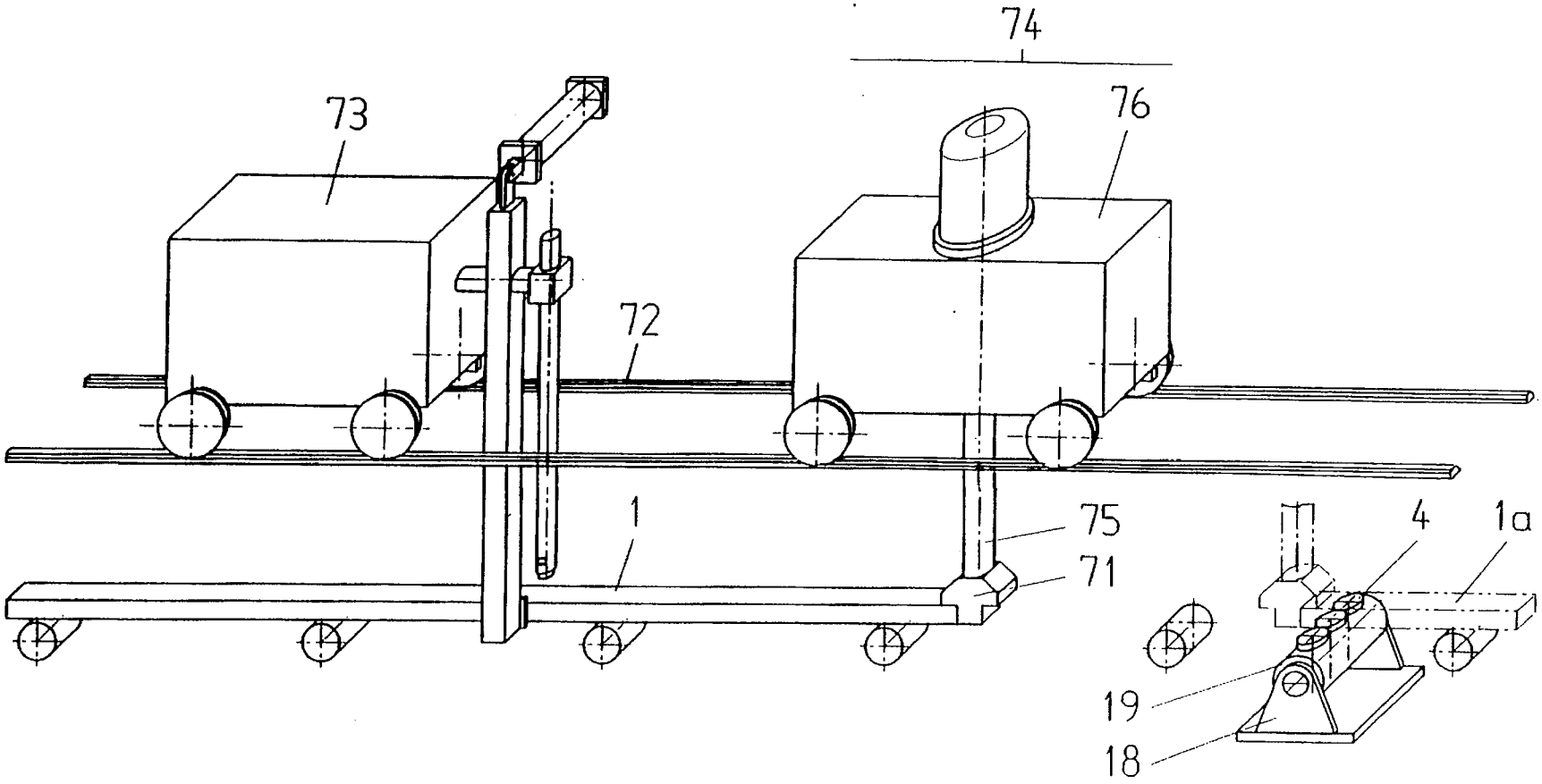
FIG. 24 is a perspective view of a work piece positioning apparatus for a deburring machine.

According to the invention, FIG. 24 shows a new device for positioning, stopping, and moving the work piece (1) over the deburrer, consisting of a piston body (19) according to invention with a deburring piston (4).

For example, on the same tracks (72) which carry a flame cutting machine (73) over a work piece (1), a deburring carriage (74) supports a liftable and lowerable plunger (75) having a hold-down/stop member (71) with cut out end portions. This assembly permits the work piece (1*a*) to be stopped, pushed down and shifted, for the transport and deburring of the work piece (1*a*), for the deburring in a stationary state (deburrer travels) and for a traveling deburring (deburrer is in a stationary state). The assembly which may be used for the front as well as for the end burr. For this purpose, the deburring carriage (74) is not only equipped with a powerful motor and a rack and pinion gear for travel along the track (72) but also with a pneumatic or hydraulic cylinder for lifting and lowering the plunger (75).

As it travels on the same track (72) as the flame cutting machine (73), the deburring carriage (74) could also be used as a mechanical stop for a length measuring device, the deburring carriage stopping the arriving work piece (1) while being distant from the flame cutting machine (73) by the desired piece length.

Figure 25:
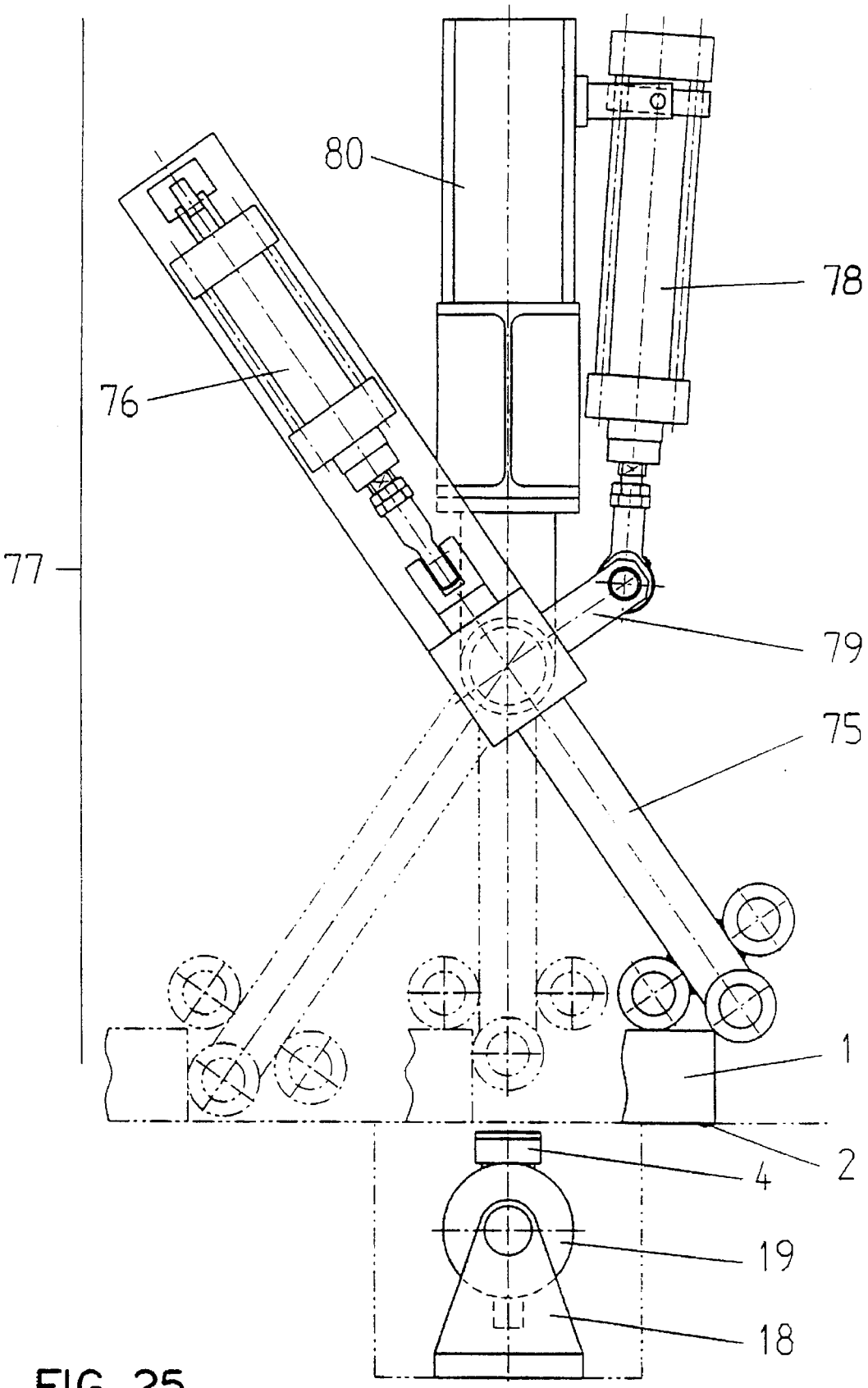
FIG. 25 is a front elevational view of a work piece positioning apparatus for a deburring machine.

FIG. 25 illustrates a stationary deburring pendulum (77) arranged above the deburrer with the deburring piston (4), piston body (19), and swivel beating (18). The deburring pendulum (77) consists of a hold/push plunger (75) pivoted on a stand (80). The plunger (75) is actuated by a hydraulic cylinder (76) and comprises rounded shoulders welded at the lower end. A second hydraulic cylinder (78) mounted on the stand (80) rotates the plunger (75) via a lever (79). The pneumatic cylinder (76) is positioned over the deburring piston (4) of the deburrer, while the work piece (1*a*) is positioned above the deburrer and rests on a rolling web (not shown) for deburring. The rolling web delivers the work piece (1*a*) and causes it to stop within the deburring area, controlled by suitable limit switches or photoelectric barriers. At this point, the plunger (75) takes over in order to deburr the end and cutting burr (2). The plunger (75) swivels or lifts up, the work piece (1*a*) travels backwards on the roller table, and the front cutting burr (2) is deburred backwards by the aid of the plunger (75) of the deburring pendulum (77). Any longitudinal adjustments of the hold-pushing plunger (75) are made by the pneumatic cylinder (76).

When transporting a round work piece (1) to and over the deburrer, the work piece (1) tends to distort to such an extent that the cutting burr (2) to be removed is no longer in the proper position required for deburring, e.g., oriented downward, or no longer fits into the deburring sector of the round deburrer. Accordingly, the round work piece should be rotated in the immediate proximity of the deburrer or over the deburrer in such a manner that all the burr areas are caught by the deburring piston (4).

Figure 26B:
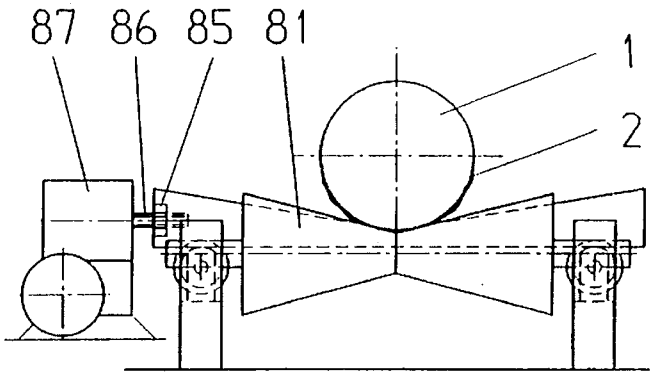
FIGS. 26*a* and 26*b* are front and side elevational views, respectively, of a circular work piece aligning apparatus for a deburring machine.
Figure 26A:
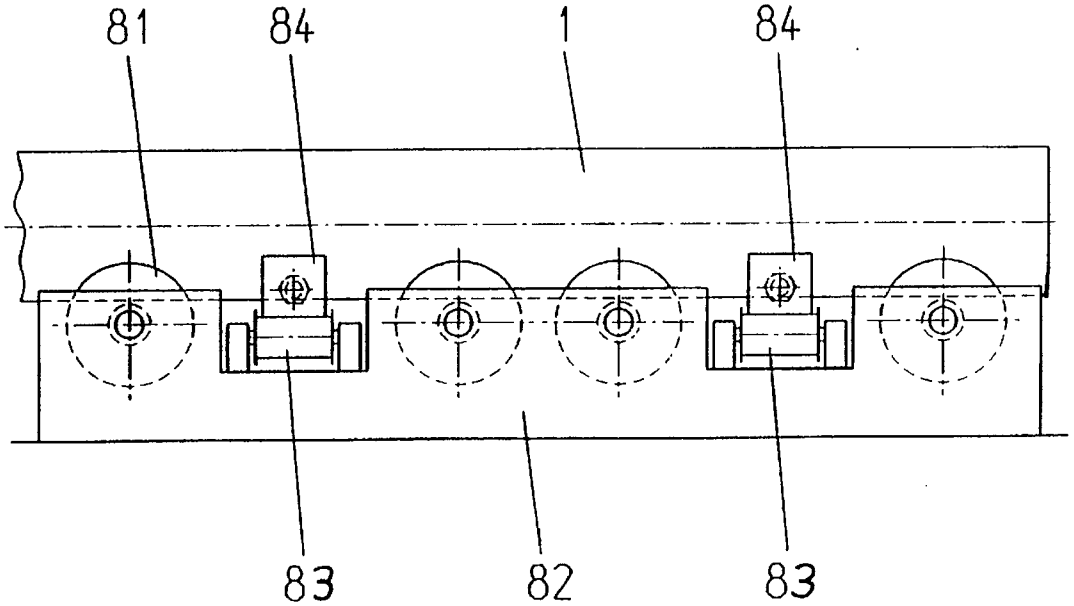

For this purpose, as demonstrated in FIGS. 26*a* and 26*b* according to the present invention, a rotation device is arranged in front of and behind the deburrer for the deburring of a cutting burr (2) for front and end surfaces. Depending on the various lengths of the round work pieces, the rotation device may consist of two or more double key bars (84) with two frictional surfaces which are inclined towards each other. The double key bars (84) are mounted on transport rollers (83) supported in a roller table frame (82). A plurality of truncated cone-shaped rolls (81) are rotatably mounted on the table frame (82).

Synchronously operated and controlled spindle drives (87) reciprocate the double key bars (84) by means of a spindle (86) and spindle nut (85) attached to the double key bars (84) below the work piece (1).

The double key bars (84) thus push and lift the round work piece (1) against the inclined surfaces of the truncated cone-shaped rolls (81), which will cause rotation of the work piece (1), until the desired position has been reached. Retraction of the double key bars (84) releases the work piece (1) which will travel in the proper rotational orientation while being deburred.

What is claimed is:

1. Apparatus for removing burrs from flame cut steel slabs comprising:

at least one substantially airtight piston chamber comprising a hollow interior;

a plurality of deburring pistons extendably mounted on the at least one substantially airtight piston chamber and communicating with the hollow interior thereof;

means for pressurizing the hollow interior of the substantially airtight piston chamber to extend the deburring pistons therefrom;

means for supporting the at least one substantially airtight piston chamber; and means for moving the substantially airtight piston chamber with respect to the slab to achieve deburring engagement between the deburring pistons and the slab.

2. Apparatus as claimed in claim 1, further comprising means for rotating the substantially airtight piston chamber in a plane substantially parallel with the surface of the slab to be deburred.

3. Apparatus as claimed in claim 1, wherein the substantially airtight piston chamber is shaped to correspond with the shape of the slab to be deburred.

4. Apparatus as claimed in claim 1, wherein each deburring piston comprises a shear head connected to a working piston and a piston shaft connected to the working piston, and wherein the working piston has a larger diameter than the piston shaft.

5. Apparatus as claimed in claim 1, wherein the number and size of the deburring pistons is selected based on the size and shape of the slab to be deburred.

6. Apparatus as claimed in claim 1, further comprising means for adjusting the position of the slab to align the burr to be removed with the deburring pistons.

7. Apparatus as claimed in claim 1, wherein each deburring piston is removably inserted into one side of the substantially airtight piston chamber.

8. Apparatus as claimed in claim 7, further comprising means for preventing ejection of the deburring pistons from the substantially airtight piston chamber during burr removal.

9. Apparatus as claimed in claim 1, wherein one of the substantially airtight piston chambers is positioned below a slab to be deburred and another of the substantially airtight piston chambers is positioned above the slab to be deburred.

10. Apparatus as claimed in claim 9, further comprising means to adjust the height of each of the substantially airtight piston chambers.

11. Apparatus as claimed in claim 1, wherein the substantially airtight piston chamber comprises a substantially cylindrical tube defining a longitudinal axis, the deburring pistons extend from the substantially airtight piston chamber substantially perpendicular to the longitudinal axis, and the substantially airtight piston chamber is rotatable about its longitudinal axis.

12. Apparatus as claimed in claim 11, wherein the substantially airtight piston chamber is rotatable into a position wherein the deburring pistons extend toward a slab to be deburred at a non-orthogonal angle inclined from 0.2° to 2° from perpendicular.

* * * * *